US007690535B2

(12) United States Patent
Law et al.

(10) Patent No.: US 7,690,535 B2
(45) Date of Patent: Apr. 6, 2010

(54) AIRLESS DISPENSING PUMP WITH TAMPER EVIDENCE FEATURES

(75) Inventors: Brian R. Law, Leicester (GB); Jeffrey William Spencer, Leicester Forest East (GB); Robert D. Rohr, LaOtto, IN (US); David J. Pritchett, Ashby De La Zouch (GB)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 12/103,397

(22) Filed: Apr. 15, 2008

(65) Prior Publication Data

US 2008/0197149 A1 Aug. 21, 2008

Related U.S. Application Data

(60) Division of application No. 11/204,848, filed on Aug. 16, 2005, now Pat. No. 7,367,476, which is a continuation-in-part of application No. 10/930,010, filed on Aug. 30, 2004, now Pat. No. 7,654,418.

(51) Int. Cl.
*B67B 1/00* (2006.01)

(52) U.S. Cl. ..... 222/153.13; 222/1; 222/153.06; 222/153.07; 222/257; 222/321.7; 222/541.9

(58) Field of Classification Search ..... 222/1, 222/153.13, 153.06, 153.07, 257, 380, 259, 222/541.1, 541.6, 387, 541.9, 383.1, 321.7, 222/384

See application file for complete search history.

(56) References Cited

U.S. PATENT DOCUMENTS 2,982,448 A * 5/1961 Leonard et al. ..... 222/153.07
2,991,913 A * 7/1961 Goth ..... 222/153.06

(Continued)

FOREIGN PATENT DOCUMENTS

CA 2 297 308 7/2004

(Continued)

OTHER PUBLICATIONS

EP Search Report dated Feb. 5, 2008 issued in EP Application No. 06253488.8.

(Continued)

*Primary Examiner*—Frederick C. Nicolas
(74) *Attorney, Agent, or Firm*—Woodard, Emhardt, Moriarty, McNett & Henry LLP

(57) ABSTRACT

An airless dispenser pump assembly includes a pump mechanism with an inlet valve that is configured to efficiently pump viscous fluids and that is able to be pre-primed when the pump mechanism is attached to a container. In one form, the inlet valve includes a seal member that seals an inlet port of the pump and an outer support member that secures the inlet valve to the rest of the pump mechanism. Two or more legs generally extend in a circumferential direction between the support member and the seal member in order to create a large flow opening for fluid flow through the inlet valve when opened and to rapidly close the inlet valve. The pump mechanism further includes an outlet valve that is configured to draw fluid back from a nozzle of the pump after dispensing in order to minimize build up around the nozzle.

19 Claims, 26 Drawing Sheets

U.S. PATENT DOCUMENTS

| | | | | | |
|---|---|---|---|---|---|
| 3,255,928 | A | * | 6/1966 | Foster | 222/153.07 |
| 3,403,823 | A | | 10/1968 | O'Donnell | |
| 4,039,139 | A | | 8/1977 | Bird | |
| 4,139,311 | A | | 2/1979 | Lorscheidt | |
| 4,154,371 | A | | 5/1979 | Kolaczinski et al. | |
| 4,323,175 | A | | 4/1982 | Eckert | |
| 4,394,939 | A | | 7/1983 | Thor et al. | |
| 4,402,431 | A | | 9/1983 | Wiegner et al. | |
| 4,438,871 | A | | 3/1984 | Eckert | |
| 4,479,589 | A | | 10/1984 | Ford | |
| 4,564,130 | A | | 1/1986 | Eulenburg | |
| 4,579,147 | A | | 4/1986 | Davies et al. | |
| 4,589,574 | A | | 5/1986 | Foster | |
| 4,781,483 | A | | 11/1988 | Lorscheidt | |
| 4,889,262 | A | | 12/1989 | Toms | |
| RE33,247 | E | | 7/1990 | Bossina | |
| 4,945,941 | A | | 8/1990 | Kocher | |
| 4,971,227 | A | * | 11/1990 | Knickerbocker et al. | 222/153.07 |
| 4,991,746 | A | | 2/1991 | Schultz | |
| 5,040,702 | A | * | 8/1991 | Knickerbocker et al. | 222/153.07 |
| 5,096,094 | A | | 3/1992 | Guilbert | |
| 5,158,233 | A | * | 10/1992 | Foster et al. | 239/333 |
| 5,209,044 | A | | 5/1993 | D'Addario et al. | |
| 5,310,112 | A | | 5/1994 | Meshberg | |
| 5,356,043 | A | | 10/1994 | Glynn | |
| 5,397,035 | A | | 3/1995 | Law | |
| 5,445,299 | A | | 8/1995 | Harriman | |
| 5,482,186 | A | * | 1/1996 | Rodden, Jr. | 222/153.07 |
| 5,497,915 | A | | 3/1996 | Wass | |
| 5,615,806 | A | | 4/1997 | Grothoff | |
| 5,655,685 | A | | 8/1997 | Carr et al. | |
| 5,664,703 | A | | 9/1997 | Reifenberger et al. | |
| 5,673,821 | A | | 10/1997 | Davis et al. | |
| 5,706,983 | A | * | 1/1998 | Dobbs et al. | 222/153.14 |
| 5,816,453 | A | | 10/1998 | Spencer et al. | |
| 5,823,394 | A | | 10/1998 | Davis et al. | |
| 5,842,605 | A | | 12/1998 | Lehmkuhl | |
| 5,850,948 | A | | 12/1998 | Garcia et al. | |
| 5,924,604 | A | | 7/1999 | Shimada et al. | |
| 5,941,422 | A | | 8/1999 | Struble et al. | |
| 5,975,370 | A | | 11/1999 | Durliat | |
| 5,992,442 | A | | 11/1999 | Urquhart et al. | |
| 6,213,633 | B1 | | 4/2001 | Kramer et al. | |
| 6,240,979 | B1 | | 6/2001 | Lorscheidt | |
| 6,257,440 | B1 | | 7/2001 | Perkins et al. | |
| 6,269,981 | B1 | | 8/2001 | Nielsen | |
| 6,309,124 | B1 | | 10/2001 | Gueret | |
| 6,321,908 | B1 | | 11/2001 | Lorscheidt | |
| 6,371,333 | B2 | | 4/2002 | Lorscheidt et al. | |
| 6,533,145 | B2 | | 3/2003 | Lewis et al. | |
| 6,729,501 | B2 | | 5/2004 | Peterson | |
| 6,752,153 | B1 | | 6/2004 | Eckert | |
| 6,772,916 | B1 | | 8/2004 | Reynolds | |
| 6,890,162 | B2 | | 5/2005 | Ding | |
| 7,059,501 | B2 | | 6/2006 | Masuda | |
| 7,111,761 | B2 | | 9/2006 | Masuda | |
| 7,367,476 | B2 | * | 5/2008 | Law et al. | 222/153.06 |
| 2001/0025863 | A1 | | 10/2001 | Lorscheidt | |
| 2003/0089738 | A1 | | 5/2003 | Peterson | |
| 2003/0168475 | A1 | | 9/2003 | Heukamp | |
| 2003/0168477 | A1 | | 9/2003 | Heukamp | |
| 2003/0231923 | A1 | | 12/2003 | Heukamp | |
| 2004/0007601 | A1 | | 1/2004 | Masuda | |
| 2004/0206781 | A1 | | 10/2004 | Lorscheidt | |
| 2004/0206783 | A1 | | 10/2004 | Danne et al. | |

FOREIGN PATENT DOCUMENTS

| | | | |
|---|---|---|---|
| CN | 2483350 | Y | 3/2002 |
| CN | 2493753 | Y | 5/2002 |
| CN | 1378883 | A | 11/2002 |
| CN | 2521166 | Y | 11/2002 |
| EP | 1 015 340 | B1 | 9/1998 |
| GB | 2 103 298 | A | 2/1983 |
| WO | WO 92/22467 | A1 | 12/1992 |
| WO | WO 99/15425 | | 4/1999 |
| WO | WO 99/39982 | | 8/1999 |
| WO | WO 02/43872 | A2 | 6/2002 |
| WO | WO 03/028898 | A1 | 4/2003 |
| WO | WO 2005/021395 | A1 | 3/2005 |

OTHER PUBLICATIONS

First Office Action dated Jan. 4, 2008 in Chinese Patent Application No. 200510087501.9, application filed Jul. 20, 2005.

Machine Translation of WO 92/22467 A1 to Herrmann.

European Patent Application 06 25 3488 Search Report mailed Apr. 7, 2008.

European Patent Application 09162368 Extended European Search Report and Opinion mailed Oct. 22, 2009.

Copending China Patent Application No. 200610107565.5 Office Action mailed Jul. 24, 2009.

* cited by examiner

AIRLESS DISPENSING PUMP WITH TAMPER EVIDENCE FEATURES

REFERENCE TO RELATED APPLICATIONS

The present application is a divisional of U.S. patent application Ser. No. 11/204,848, filed Aug. 16, 2005, now U.S. Pat. No. 7,367,476 which is a continuation-in-part of U.S. patent application Ser. No. 10/930,010, filed Aug. 30, 2004, now U.S. Pat. No. 7,654,418 which are hereby incorporated by reference in their entirety.

BACKGROUND

The present invention generally relates to airless dispensing pumps, and more specifically, but not exclusively, concerns an airless dispensing pump with tamper evidence features.

Airless type pumps have been developed for a wide range applications including dispensing personal care products, such as skin creams, skin lotions, toothpaste and hair gels, as well as food sauces, and the like. Many such products deteriorate rapidly when placed in contact with air and so it is important to prevent air from entering the package when dispensing the product. In typical dispensing pump applications, air is allowed to enter the container via a venting path in order to equalize the pressure inside the pack as product is dispensed. Were this not the case, the container would progressively collapse or, in the case of rigid containers, the increasing vacuum in the container would exceed the ability of the dispensing pump to draw product out of the container.

With conventional dispensing pumps having a suction pipe or tube, the ability to evacuate the entire contents of the container is relatively poor for viscous products. Usually, the viscous product, such as a cream, is drawn up the suction pipe, which initially works well, but the viscous product does not self-level. As a result, a cavity or hole is formed in the surface of the product to a point where the dispensing pump dispenses only air because it is unable to dispense the product that remains adhered to the sidewalls of the container. As a result, it is common for only about 50% to 60% of the total pack contents of the viscous product to be dispensed with conventional dispensing pumps.

In airless type dispensing systems, there are two common ways to overcome the above-mentioned problems, either by using a collapsible bag type design or by using a follower piston type design. With the collapsible type design, a collapsing bag is attached to the dispensing pump, which progressively collapses as the contents are removed. In the follower piston type design, a rigid container, usually cylindrical or oval in form, has a follower piston that progressively reduces the container volume as product is drawn out by the dispensing pump.

In either type of airless dispensing system, initial priming of the pump mechanism can be somewhat difficult due to the viscous nature of the contents. Even when properly primed, the pump mechanism may not dispense a sufficient amount of fluid due to constrictions within the pumping mechanism, especially the valves. With viscous products, the valves within the pump mechanism need to provide relatively large flow openings, but at the same time, close rapidly to ensure that the product is efficiently pumped. Due to differences in viscosities of various products, it is difficult to easily and inexpensively reconfigure the pumping mechanism to accommodate products with different properties. It is also desirable for a number of products, such as pharmaceuticals, to not come in contact with metal, which can tend to contaminate the pharmaceutical product, and therefore, there is a need to minimize or even eliminate metallic component contact within the pumping mechanism. In typical airless pump designs, after dispensing, product may remain at the outlet of the dispensing head where the product may dry or harden due to contact with air. The dried product usually creates an unsightly appearance, and sometimes can lead to clogging of the outlet. During shipment, container leakage is always a concern. With pharmaceuticals, food products, personal hygiene products as well as other products where product safety is a concern, a clearly identifiable tamper evidence feature for the container and pump mechanism is needed.

Thus, there is a need for improvement in this field.

SUMMARY

One aspect of the present invention concerns an airless dispenser pump assembly. The assembly includes a pump mechanism that defines a pump cavity with an inlet port through which viscous fluid from a container is supplied. The pump mechanism includes a piston slidably received in the pump cavity to pump the fluid from the pump cavity. An outlet valve member is configured to permit flow of the viscous fluid out of the pump cavity during a dispensing stroke of the piston and to form a vacuum in the pump cavity during an intake stroke of the piston. An inlet valve member covers the inlet port, and the inlet valve member includes an outer support member and an inner seal member that is sized to seal the inlet port during the dispensing stroke of the piston. Two or more connection legs connect the outer support member to the inner seal member for rapidly closing the inlet port during the dispensing stroke of the piston. At least one of the connection legs includes a circumferential portion that extends in a circumferential direction around the seal member to provide a large flow aperture for the viscous fluid between the legs during the intake stroke of the piston.

Another aspect concerns a dispenser pump valve that includes a valve opening and a valve member. The valve member includes an outer support member disposed around the valve opening and an inner seal member that is sized to seal the valve opening. Two or more connection legs connect the outer support member to the inner seal member. At least one of the connection legs includes a portion that extends in a peripheral manner around the inner seal member.

A further aspect concerns a dispenser pump assembly that includes a pump mechanism that defines a pump cavity. The pump mechanism includes an inlet valve member for controlling flow of fluid into the pump cavity and a piston slidably received in the pump cavity to pump the fluid from the pump cavity. The piston defines a flow passage through which the fluid from the pump cavity is pumped. A pump head has a dispensing outlet fluidly coupled to the flow passage for dispensing the fluid. An outlet valve member is received in the flow passage of the piston for controlling flow of the fluid out of the pump cavity. The flow passage includes a first portion sized to create a piston like fit between the first portion and the outlet valve member for drawing the fluid back from the dispensing outlet after the fluid is dispensed. The second portion is sized larger than the first portion to allow the fluid to flow around the outlet valve member during dispensing of the fluid.

Still yet another aspect concerns a technique for pre-priming a pump. The pump includes an inlet valve member that seals an inlet port of the pump. The inlet valve member includes an outer support member, an inner seal member that seals the inlet port and at least two connection legs that connect the outer support member to the inner seal member. A container is filled with fluid through a top opening of the container. The pump is primed by securing the pump to the top opening of the container so that pressure of the fluid inside the container opens the inlet valve member to at least partially fill the pump cavity with the fluid.

A further aspect concerns a dispenser pump assembly. The assembly includes a container that includes a skirt flange with a skirt groove. A pump with a skirt is received in the skirt groove. The skirt includes a break tab that is configured to form a grip opening once the break tab is removed that permits removal of the pump from the container.

Another aspect concerns a pump assembly that includes an airless dispensing pump. The pump includes a pump head that is moveable in a telescoping fashion to pump a fluid and a nozzle opening from where the fluid is pumped. A tamper evidence band is wrapped around the pump head to prevent movement of the pump head in the telescoping fashion. The tamper evidence band has a nozzle plug received in the nozzle opening, and the tamper evidence band has a breakable portion configured to break the band upon the user pulling on the nozzle plug for permitting movement of the pump.

Further forms, objects, features, aspects, benefits, advantages, and embodiments of the present invention will become apparent from a detailed description and drawings provided herewith.

DESCRIPTION OF SELECTED EMBODIMENTS

Figure 1:
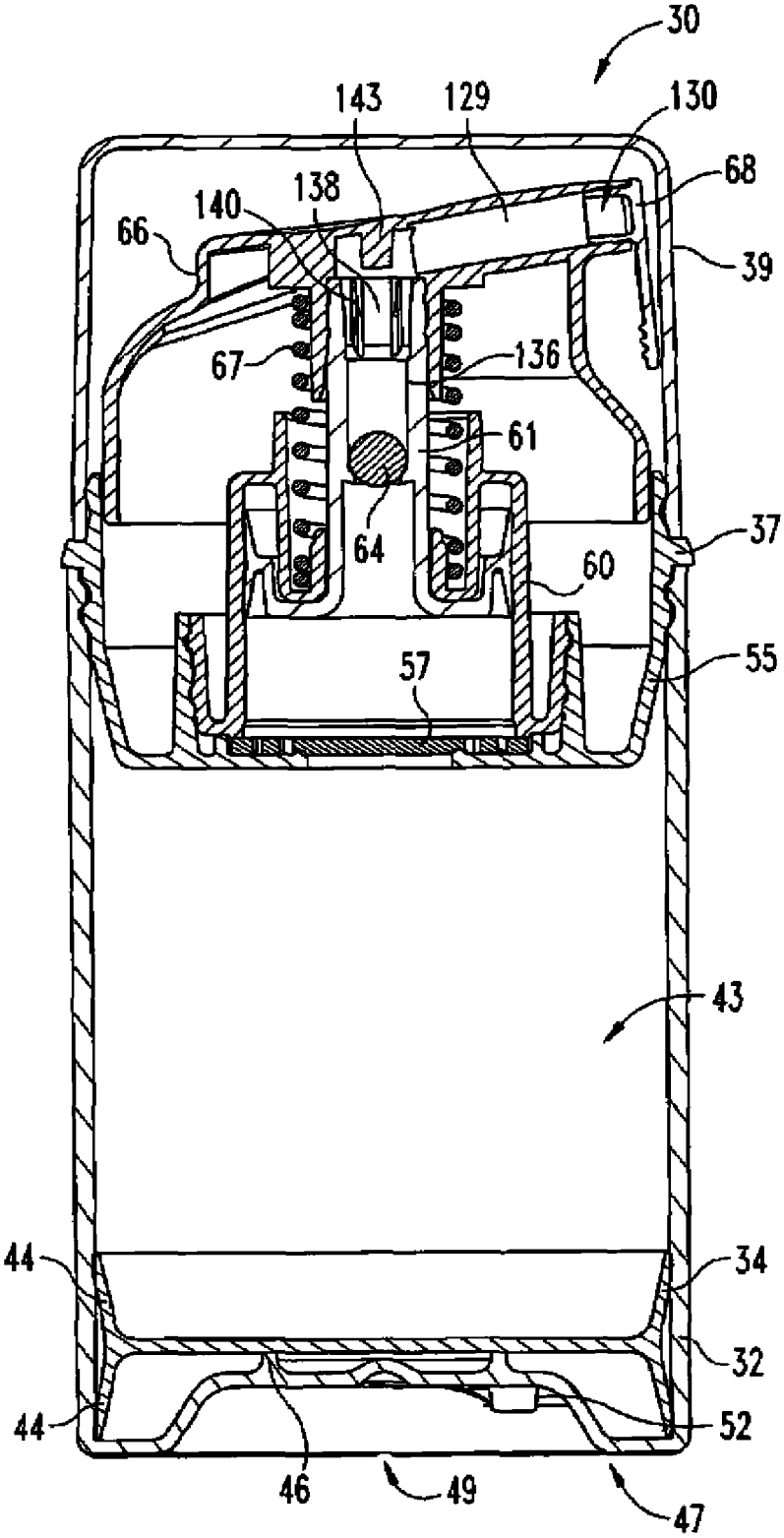
FIG. 1 is a cross-sectional view of a fluid dispensing assembly according one embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail; although it will be apparent to those skilled in the relevant art that some features that are not relevant to the present invention may not be shown for the sake of clarity.

Figure 2:
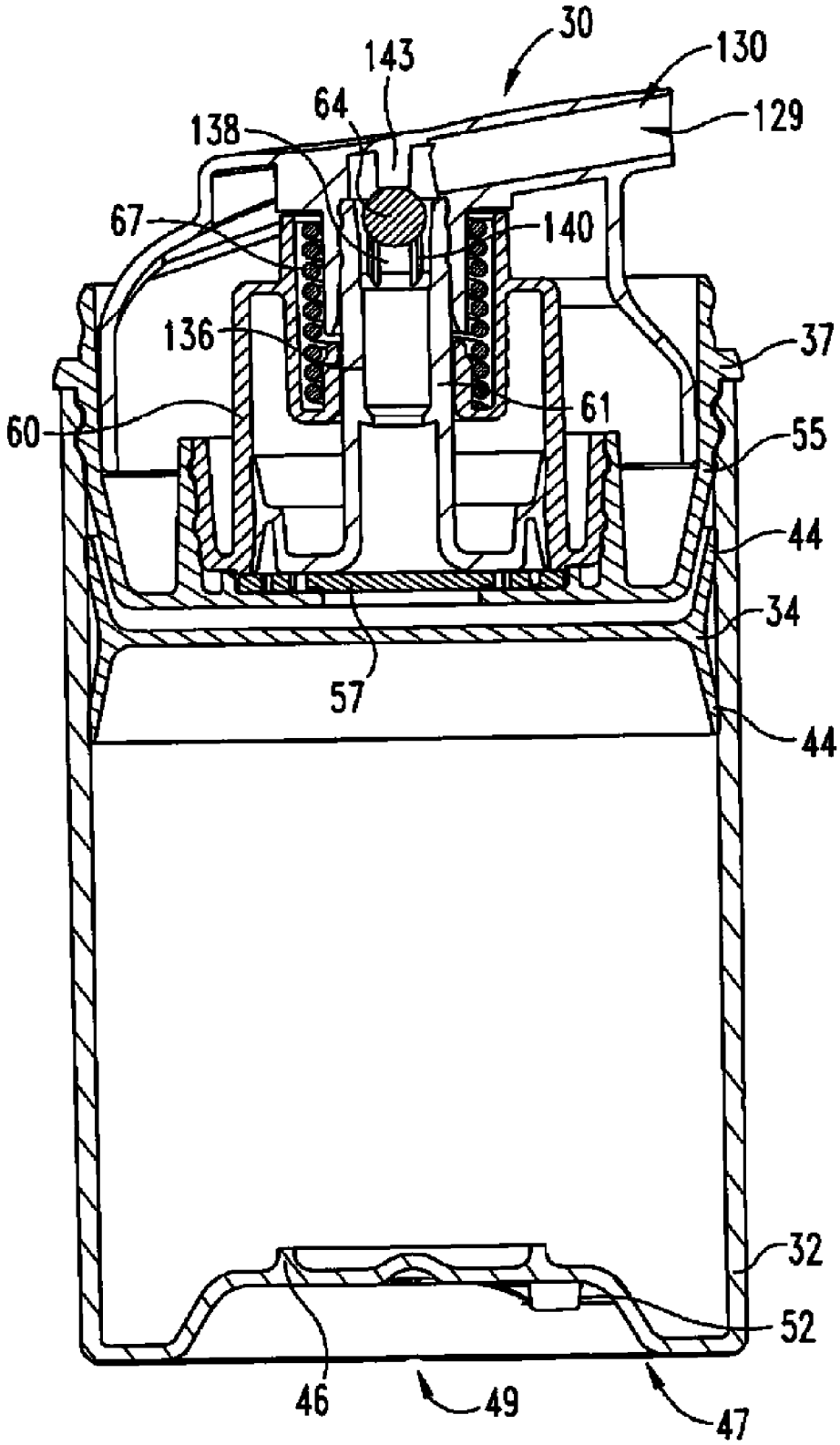
FIG. 2 is a cross-sectional view of the FIG. 1 assembly during a dispensing stroke.

An airless pump assembly 30 according one embodiment, among others, of the present invention is illustrated in FIGS. 1 and 2. As shown, the pump assembly 30 includes a container 32 for storing fluid, a follower piston 34 received in the container 32, a pump 37 for pumping fluid from the container 32, and a cap 39 that covers the pump 37. FIGS. 1 and 2 show two cross-sectional elevations, one of which, FIG. 1, shows the follower piston 34 at the bottom of the container 32 with the pump 37 at the top of its stroke, and the other, FIG. 2, shows the follower piston 34 at the point where virtually the entire contents of the container 32 have been dispensed with the pump 37 at the bottom of its stroke. It should be noted that directional terms, such as "up", "down", "top", "bottom", "left" and "right", will be solely used for the convenience of the reader in order to aid in the reader's understanding of the illustrated embodiments, and that the use of these directional terms in no way limits the illustrated features to a specific orientation. The pump assembly 30 will be described with reference to a follower piston type system, but it should be realized that selected features from the assembly 30 can be adapted for use with other types of pumping systems, such as with a collapsible bag type airless dispenser pump.

With reference to FIG. 1, the follower piston 34 is slidably received inside a cavity 43 in the container 32, and the follower piston 34 has upper and lower seal members 44 that seal against the container 32. An upstanding ring or support 46 at base 47 of the container 32 prevents the follower piston 34 being pushed too far into the base 47 of the container 32 during packing, thereby minimizing the risk of damage to the lower piston seal member 44. As fluid is dispensed from the container 32, a slight vacuum is formed, and consequently, the follower piston 34 slides up the cavity 43 to reduce the effective size of the cavity 43. At the base 47, the container 32 has one or more vent grooves 49 as well another opening (not show) that vent the container 32 in order to prevent a vacuum from forming between the underside of the follower piston 34 and the base 47 of the container 43 as the follower piston 34 moves progressively upwards during dispensing. The base 47 of the container 32 further has a drive dog 52, which allows the outside of the container 32 to be printed. In the illustrated embodiment, the container 32 as well as other components have a generally cylindrical shape, but it should be appreciated that these components can be shaped differently in other embodiments.

Figure 3:
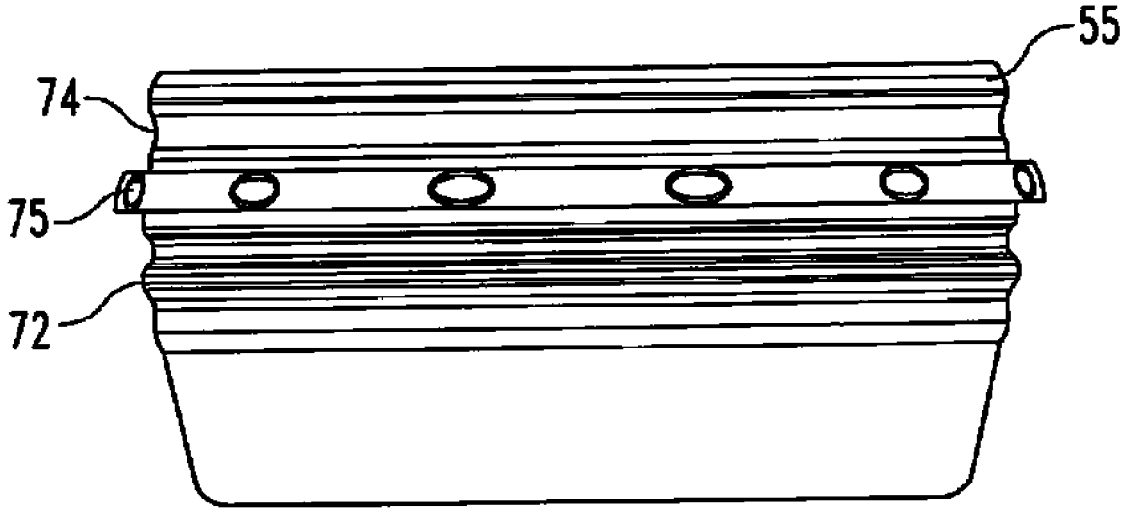
FIG. 3 is a front view of a pump body used in the FIG. 1 assembly.
Figure 4:
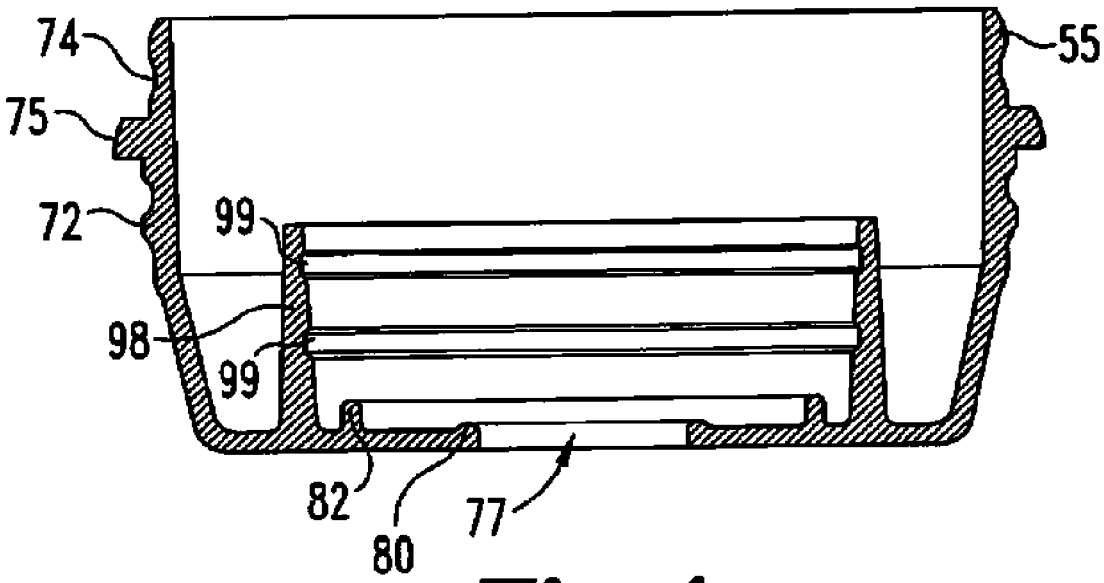
FIG. 4 is a front, cross-sectional view of the FIG. 3 pump body.

In the pump assembly 30, the pump 37 is secured to the container 32 through a snap fit type connection. Nevertheless, it should be appreciated that the pump 37 can be secured to the container 32 in other manners. As shown in FIGS. 1 and 2, the pump 37 includes a pump body 55 that is secured to the container 32, an inlet valve member 57 that controls the flow of fluid into the pump 37, a pump cylinder 60 in which a pump piston 61 is slidably disposed, an outlet valve member 64, a pump head 66 for dispensing the fluid, a return spring 67 and a nozzle plug 68. Looking at FIGS. 3 and 4, the pump body 55 has one or more ridges 72 that snap into corresponding grooves in the container 32. The pump body 55 further has a cap groove 74 to which the cap 39 is secured and a retention flange 75 positioned between the ridges 72 and the cap groove 74. At one end, the pump body 55 defines an inlet port 77 through which fluid is received from the container 32, as is illustrated in FIG. 4. Around the inlet port 77, the pump body 55 has a seal ridge or seat 80 that biases against and seals with the inlet valve member 57, and surrounding the seal ridge 80, the pump body 55 further has a valve retainer ridge 82 that aligns the inlet valve member 57 over the inlet port 77.

Figure 5:
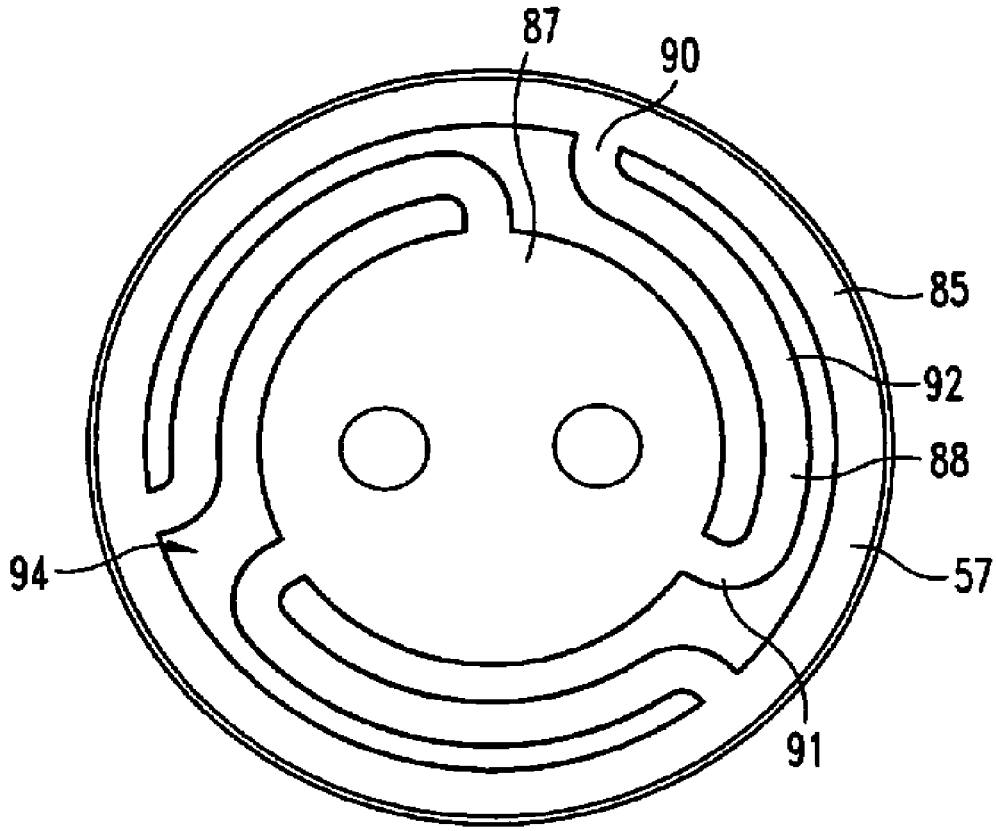
FIG. 5 is a top view of an inlet valve for the FIG. 1 assembly.
Figure 6:
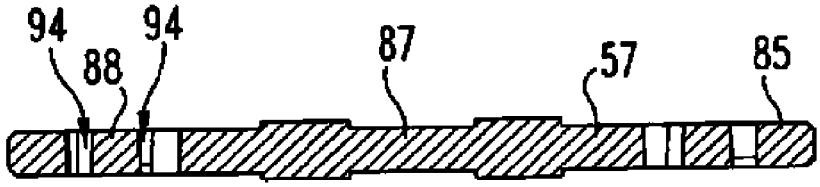
FIG. 6 is a side, cross-sectional view of the FIG. 5 inlet valve.

The inlet valve member 57 has a unique design that provides a number of advantages when dispensing viscous creams or other viscous fluids. As can be seen in FIGS. 5 and 6, the inlet valve member 57 has generally flat disk shape, but as should be understood, the inlet valve member 57 can have a different overall shape in other embodiments. The inlet valve member 57 includes an outer peripheral ring or support member 85 and an inner seal member 87 that is connected to the outer support member 85 through two or more connection legs 88. The outer support member 85 in the embodiment shown is in the form of a continuous ring, but it is envisioned that the outer support member 85 can have a different overall shape. For example, the outer support member 85 in other embodiments can include discontinuous segments. In the illustrated embodiment, the inlet valve member 57 has three legs, but in other embodiments, the valve 57 can have two or even more than three legs. Each leg 88 includes an outer portion 90 that generally extends radially inwards from the outer support member 85 and an inner portion 91 that extends radially outwards from the seal member 87. Between the outer 90 and inner 91 portions, each leg 88 has a circumferential portion 92 that extends between the support member and the seal member 87 in a circumferential direction such that the leg 88 generally extends around the periphery of the seal member 87. As shown, the legs 88 are surrounded on both sides by flow apertures 94. In the illustrated embodiment, the outer 90 and inner 91 portions of each leg 88 are radially offset about equidistantly from one another, which in this case is about one-hundred and twenty degrees (120°), so that the legs 88 are generally in the form of equal arc segments. In another embodiment where two legs 88 are used instead of three, the legs 88 almost form one-hundred and eighty degree (180°) arc segments, thereby allowing further lengthening the legs 88 for a given size of the inlet valve member 57. The length and shape of the legs 88 ensures that the inner seal member can lift from the seat 80 to enable the creation of a series of large openings through the apertures 94, which allow the easy flow of viscous fluid into the pump 37. By having the legs 88 extend in a circumferential or peripheral manner, the legs 88 can be longer than if they just extended in a radial direction, and with the legs 88 being longer, larger flow openings can be formed. Not only does the design of the inlet vale 57 allow large apertures to be created for the easy flow of viscous fluid; it just as importantly allows the inlet valve member 57 to close in an extremely quick manner. With two or more legs 88 pulling around the seal member 87, the seal member 87 is able to quickly seal against the seat 80. The speed with which the seal member 87 closes onto the valve seat 80 can also be adjusted either by changing the width, thickness and/or number of the legs 88, or by using a more or less rigid material. Consequently, the pumping action of the pump 37 can be modified to accommodate fluids with different characteristics by simply replacing the inlet valve member 57 with one having different properties. For example, it was discovered that using three equally sized legs 88 provided desirable flow opening sizes as well as favorable closing characteristics.

In one embodiment, the inlet valve member 57 is made of plastic in order to avoid product contamination with metal. As noted before, it is desirable that pharmaceutical products do not come into contact with metal in order to avoid contamination. In one particular form, it was found that the inlet valve member 57 works well when produced with a polyolefin material (polyethylene/polypropylene family), which can be relatively inexpensive. It is contemplated that the inlet valve member 57 can be made of other materials, however. For instance, the inlet valve member 57 can also be made in more sophisticated polymers in applications requiring operation in heat or where chemical compatibility is a factor. Except for the spring 67 and possibly the outlet valve member 64, all remaining components of the assembly 30 can be produced with polyolefin materials, which tend to reduce manufacturing costs. However, it should be understood that the components of the assembly 30 in other embodiments can be made of different materials, such as metal, if so desired.

Figure 7:
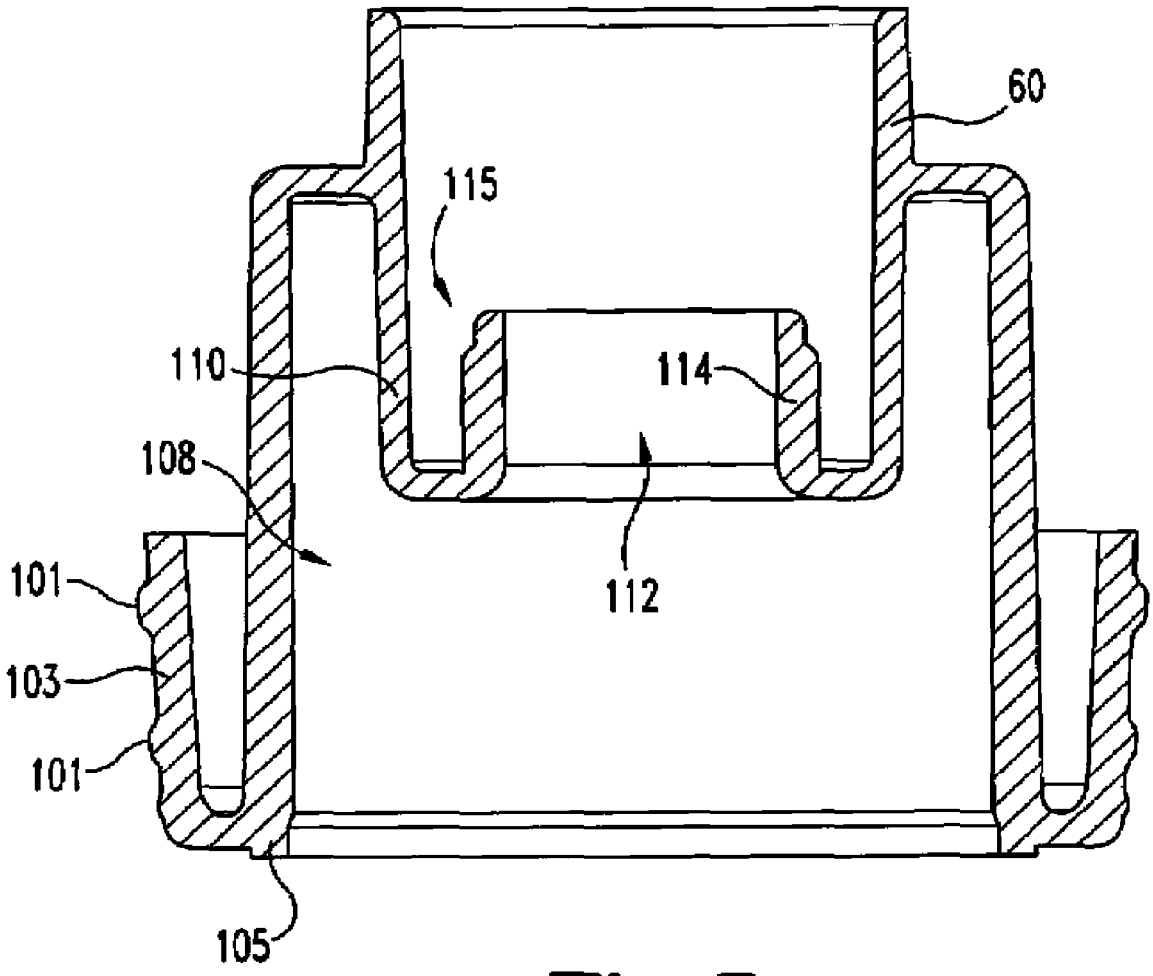
FIG. 7 is a cross-sectional view of a pump cylinder for the FIG. 1 assembly.

Looking again at FIGS. 1 and 2, when assembled into the pump 37, the inlet valve member 57 is sandwiched between the pump body 55 and the pump cylinder 60. The pump body 55 in FIG. 4 has a connector 98 that extends around inlet port 77 as well as the valve retainer ridge 82. Inside, the connector 98 has one or more snap grooves 99 that receive corresponding snap ridges 101 on a body engagement flange 103 that extends from the pump cylinder 60, which is illustrated in FIG. 7. At one end of the pump cylinder 60, facing the inlet valve member 57, a retention ridge 105 on the pump cylinder 60 clamps against the support member 85 on the inlet valve member 57. This ensures that the inlet valve member 57 cannot escape and is always held in correct relationship relative to the inlet port 77 in the pump body 55. In order to ensure rapid priming, the seal member 87 is biased to the closed position by the seat 80 around the inlet port 77 of the pump body 55 so that the inlet valve member 57 becomes virtually airtight during the initial priming of the pump 37. The amount of pre-load bias can be varied depending on the particular requirements. For example, the seat 80 in one embodiment extends about 0.3 mm high around the inlet port 77.

The pump cylinder 60 defines a pump cavity or chamber 108 in which the piston 61 is slidably received. Although the pump cylinder 60 and cavity 108 in FIG. 7 are generally cylindrical in shape, it is envisioned that they can have a different overall shape in other embodiments, such as a rectangular shape. A piston guide 110 with a guide opening 112 extends within the pump cavity 108 of the pump cylinder 60, and a guide flange 114 extends around the guide opening 112. Together, the piston guide 110 and the guide flange 114 define a spring retention groove 115 in which the spring 67 is received (FIG. 1).

Figure 9:
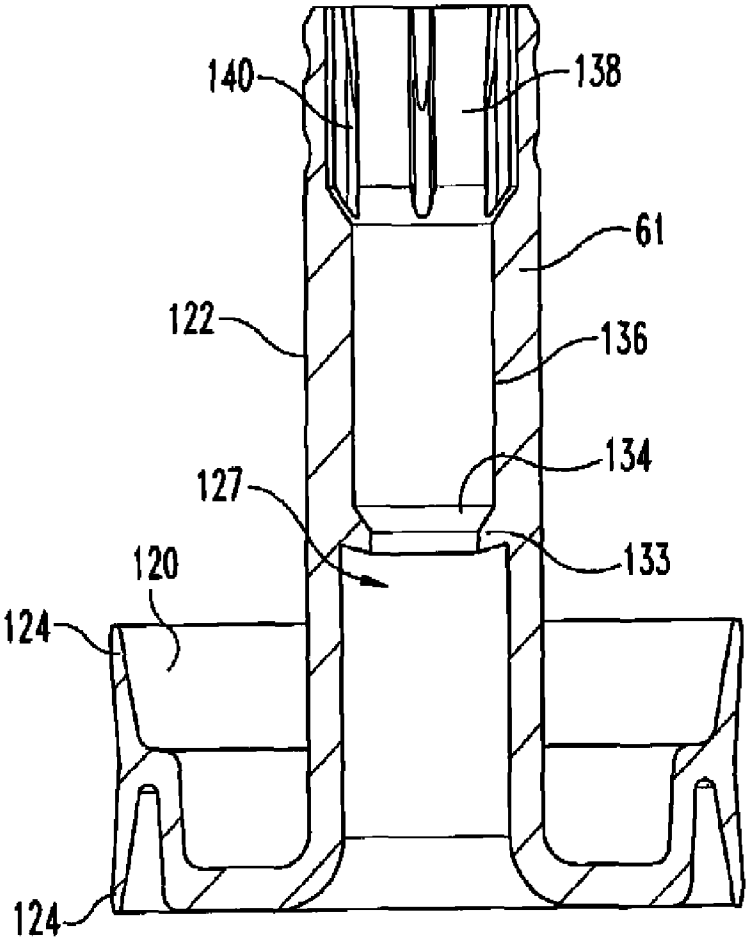
FIG. 9 is a front, cross-sectional view of the FIG. 8 piston.
Figure 8:
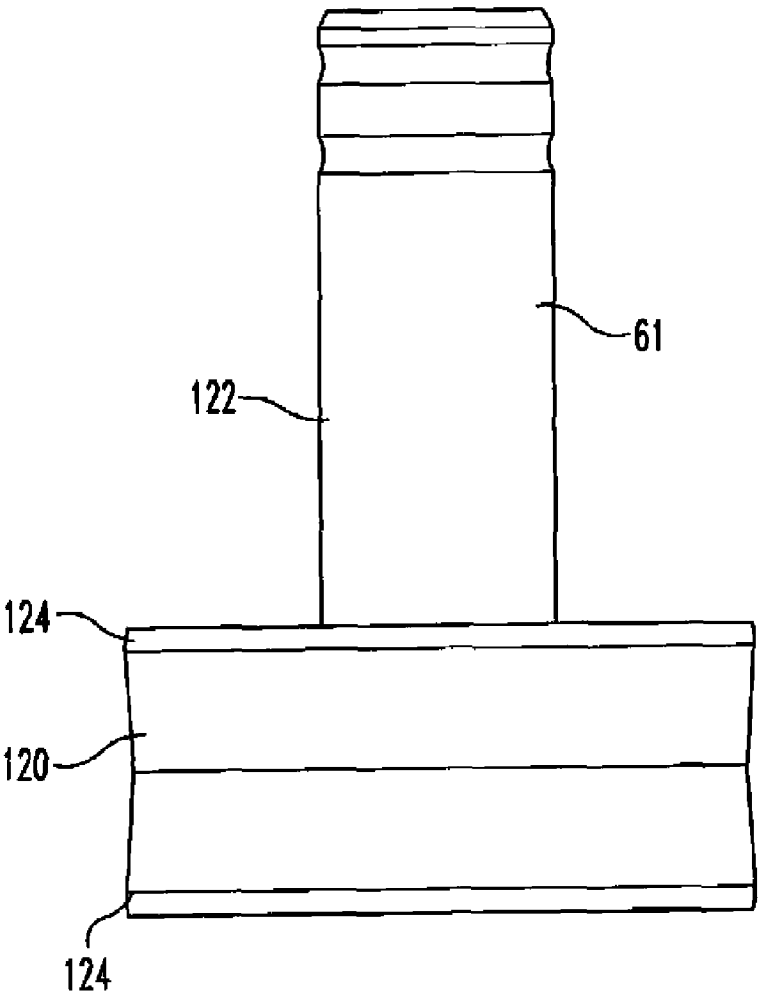
FIG. 8 is a front view of a piston in the FIG. 1 assembly.

As shown in FIGS. 8 and 9, the piston 61 has a piston head 120 that is attached to a shaft or stem 122. The piston head 120 has upper and lower seal members 124 that extend at a slight angle away from the piston head 120 in order to seal against the walls of the pump cavity 108. Both the piston head 120 and the shaft 122 of the piston 61 define a flow passage 127 through which the fluid is pumped. At the end of the shaft 122, opposite the piston head 120, the pump head 66 is snap fitted to the shaft 122, as is depicted in FIGS. 1 and 2. However, it should be recognized that the pump head 66 can be coupled to the shaft 122 in other manners. As illustrated, an outlet nozzle 129 with an outlet opening 130 in the pump head 66 is fluidly coupled to the flow passage 127 in the shaft 122 so that the fluid from the container 32 can be dispensed to the user. It should be noted that the spring 67 is mounted on the outside of the shaft 122, between the pump head 66 and the pump cylinder 60, and as a consequence, the spring 67 does not come into contact with the product being dispensed. As previously noted, this can be particularly important for pharmaceutical products where it is vital that the pharmaceutical product does not come into contact with metal.

The pump 37 in the illustrated embodiment is configured to minimize the amount of fluid that remains at the outlet opening 130 of the pump head 66, where the fluid may dry or harden due to contact with air. To remedy this problem, the pump 37 incorporates a suck-back feature in which fluid in the outlet opening 130 is sucked back into the pump 37. With reference to FIGS. 1 and 9, the piston 61 has in the flow passage 127 a valve seat or flange 133 with a conical surface 134, against which the outlet valve member 64 seals. The outlet valve member 64 acts like a check valve to permit flow of the fluid in only one direction. In the illustrated embodiment, the outlet valve member 64 has a generally spherical or ball shape, but it should be understood that the outlet valve member 64 can be shaped differently in other embodiments. For instance, the outlet valve member 64 in other embodiments can have a cylindrical shape. In order to minimize metal contact within the pump 37, the outlet valve member 64 in one embodiment is manufactured in a non-metallic material. For example, the outlet valve member 64 in one embodiment is made of glass; however, a wide range of plastic materials can also be used in other embodiments. In systems where metal contact is not a concern, it is contemplated that the outlet valve member 64 can be made of metal.

Downstream from the valve seat 133, the flow passage 127 has a first portion 136 that is just slightly larger than the diameter (size) of the outlet valve member 64 so as to allow movement of the outlet valve member 64, while still preventing the passage of fluid around the outlet valve member 64. This tight fit between the outlet valve member 64 and the first portion 136 of the flow passage 127 creates a piston like fit that is used to draw fluid back from the outlet nozzle 129 during the upstroke of the piston 61. Near the pump head 66, the flow passage 127 has a second portion 138 that is larger than the first portion 136 such that the second portion 138 is sized large enough to permit fluid to flow around the outlet valve member 64 during the down stroke of the piston 61. In the second portion 138, the piston 61 has ribs 140 that center the outlet valve member 64 over the first portion 136 so that the outlet valve member 64 is able to drop back into the first portion, as is shown in FIG. 2. The ribs 140 extend radially inwards and along the axis of the flow passage 127. Without the ribs 140 or some other centering structure, the outlet valve member 64 could move to one side which could cause its return to the seat 133 to be delayed, and in the worst case scenario, could cause air to be sucked back into the pump cavity 108. At one end of the flow passage 127, the pump head 66 has a stop member 143 that limits the travel of the outlet valve member 64 to between the valve seat 133 and the stop member 143. In other embodiments, it is contemplated that the pump 37 can further incorporate a spring or other type of biasing device to bias the outlet valve member 64 against the valve seat 133. By incorporating this suck back feature into the piston 61, assembly of the piston mechanism is simplified.

The pump 37 in the illustrated embodiment is a manually operated by pressing on the pump head 66, but it should be appreciated that the pump 37 in other embodiments can be automatically actuated. Before use, both the cap 39 and plug 68 are removed from the pump 37. After the pump head 66 is pushed down, the spring 67 causes the piston 61 as well as the pump head 66 to return to an extended position. On this upstroke or intake stroke of the piston 61, the outlet valve member 64 travels from the second portion 138 of the flow channel 127 (FIG. 2) to the first portion 136 (FIG. 1). Once the outlet valve member 64 reaches the first portion 136, the outlet valve member 64 tightly slides within the first portion 136 and acts like a virtual piston, which draws back the fluid from the outlet nozzle 129 well inboard to a position in the flow passage 127 above the outlet valve member 64. By drawing the fluid from the nozzle 129, the chance of fluid encrusting at the outlet opening 130 is reduced. During the upstroke, the outlet valve member 64 eventually sits in the valve seat 133 to create a vacuum in the pump cavity 108, as is shown in FIG. 1. The vacuum formed in the pump cavity 108 causes the inlet valve member 57 to open, thereby providing a wide through path for the fluid from the container 32 to enter into the pump cavity 108. On the down or dispensing stroke of the pump 37, the inlet valve member 57 shuts to prevent the fluid in the pump cavity 108 from being pushed back into the container 32. The outlet valve 64 lifts off the valve seat 133 to allow fluid to be dispensed via the head nozzle 129. Specifically, as the outlet valve member 64 travels in the first portion 136, the fluid is unable to pass around the outlet valve member 64, but once the outlet valve member 64 reaches the larger second portion 138 of the flow passage 127, the fluid is able to pass around the outlet valve 57 and out the nozzle 129. Additional fluid can be dispensed by pressing and releasing the pump head 66 in the manner as described above.

Figure 10:
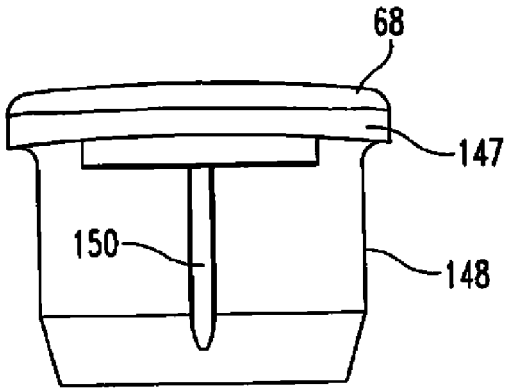
FIG. 10 is a bottom view of a plug in the FIG. 1 assembly.
Figure 11:
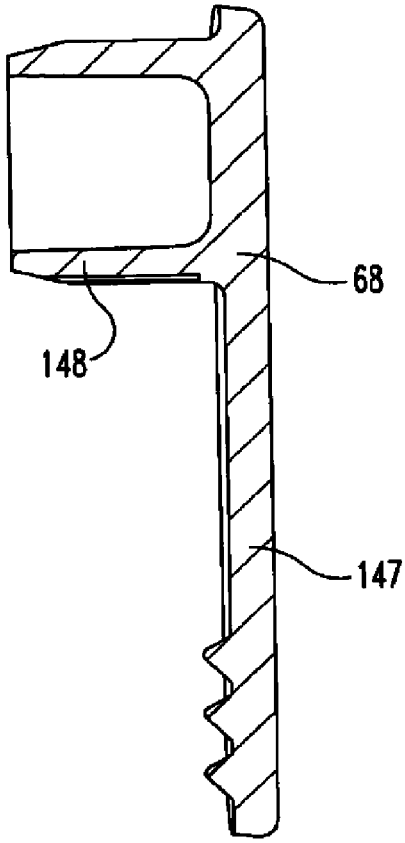
FIG. 11 is a side, cross-sectional view of the FIG. 10 plug.

To make sure that the outlet 130 of the nozzle 129 remains clean during initial shipment, the nozzle plug 68 is plugged into the nozzle 129 to ensure that there is no leakage of the fluid. Looking at FIGS. 10 and 11, the plug 68 includes a handle or tab 147 that is used to pull the plug 68 from the nozzle 129 and a plug portion 148 that is plugged into the outlet opening 130 of the nozzle 129. The plug portion 148 incorporates a fine vent channel 150 that is sized small enough to prevent leakage of medium to high viscosity fluids, but allows air to escape during initial priming of the pump 37. To also aid in minimizing leakage during shipping, the pump 37 is covered by the cap 39. The cap 39 ensures that the pump head 66 cannot be inadvertently depressed during transit as well as keeps the dispensing pump 37 in prime condition and clean for display purposes. The cap 39 also enables the total package to withstand high top loads, which can result when quantities of packs are stacked on top of each other.

Before filling the container 32, the follower piston 34 is pre-assembled into the container 32 and pushed to the bottom position, as is shown in FIG. 1. As mentioned before, the support 46 in the container 32 prevents the follower piston 34 being pushed too far into the base 47 of the container 32. The design of the pump assembly 30 lends itself to "top-filling" in that the container 32 is normally passed down a filling line and filled from the top with the fluid or product being initially dispensed on top of the follower piston 34. In one form, a diving nozzle, which is used to fill the container 32, initially dives inside the cavity 43 to the bottom of the container 32 immediately above the follower piston 34 and progressively retracts as the fluid is dispensed. This technique ensures the minimum entrapment of air, which can be detrimental to the performance of the assembly 30. Once the appropriate filling level has been achieved, the dispensing pump 37, along with the plug 68 and cap 39, is snap-fitted to the top of the container 32. In the process of snapping the dispensing pump 37 to the container 32, the fluid in the container 32 forces the inlet valve member 57 to open and partially primes the pump cavity 108. The very fine vent channel 150 in the plug 68 ensures that the entrapped air, which becomes pressurized as the pump 37 is snapped into place, is allowed to escape so as to ensure that there is no resistance to the opening of the inlet valve member 57 for priming purposes. Venting air through the vent channel 150 further reduces the danger of product spillage at the snap-fit between the container 32 and the pump body 55. By pre-priming the pump 37 in such a manner ensures that even with the most viscous fluid, a minimal number of priming strokes are required in order for the pump 37 to commence operation.

Figure 12:
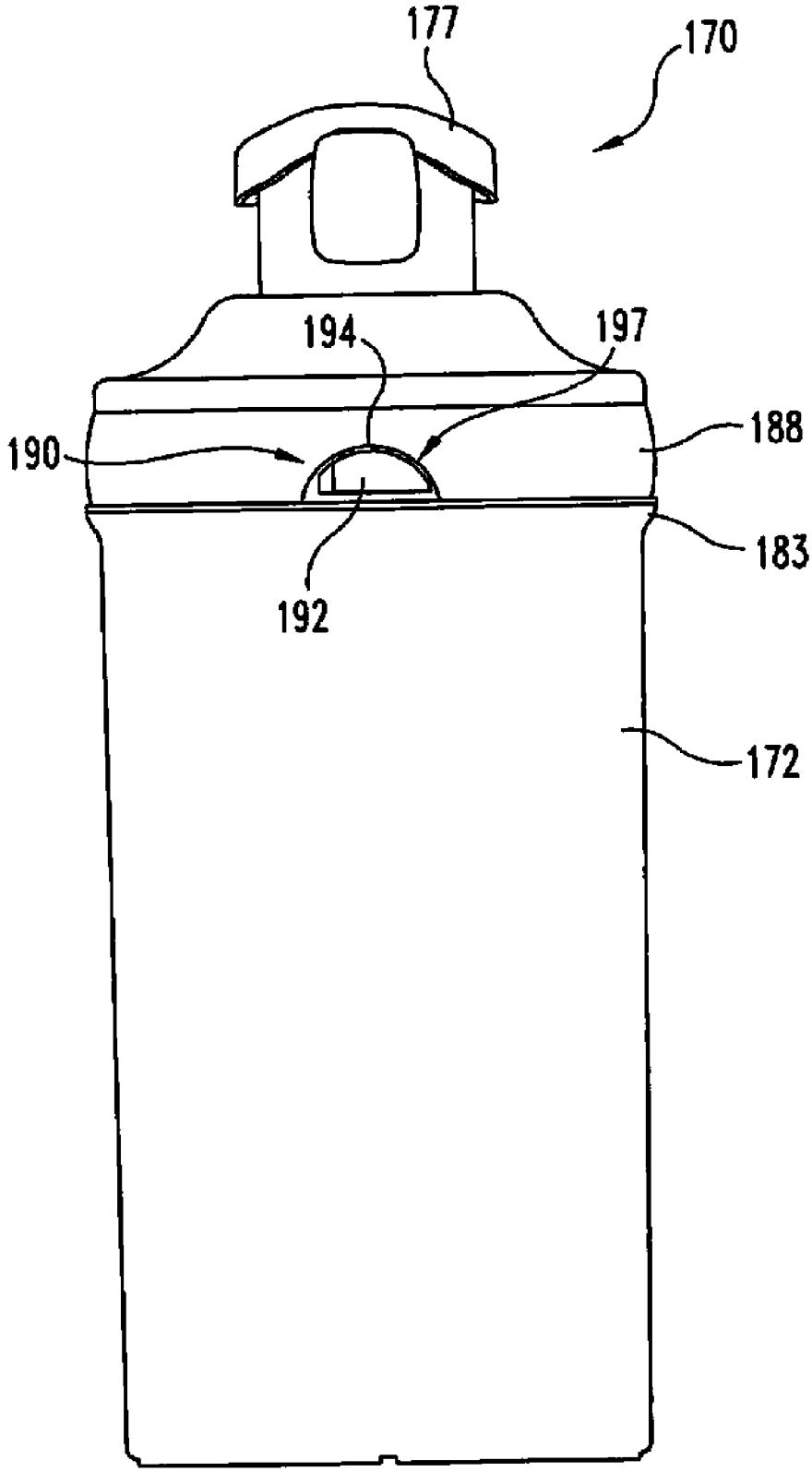
FIG. 12 is a front view of an airless dispensing pump assembly according to another embodiment.
Figure 13:
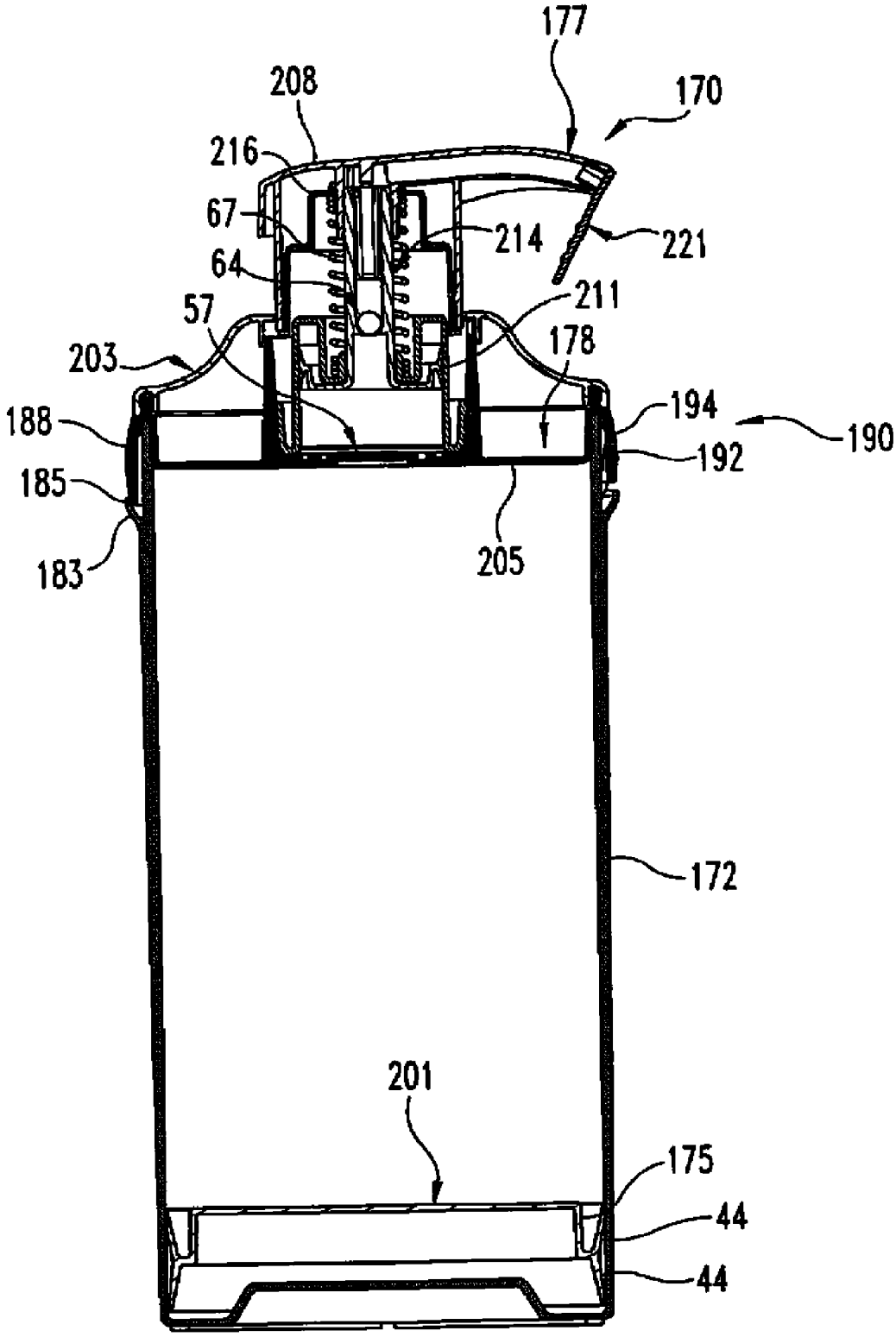
FIG. 13 is a side, cross-sectional view of the FIG. 12 pump assembly.
Figure 14:
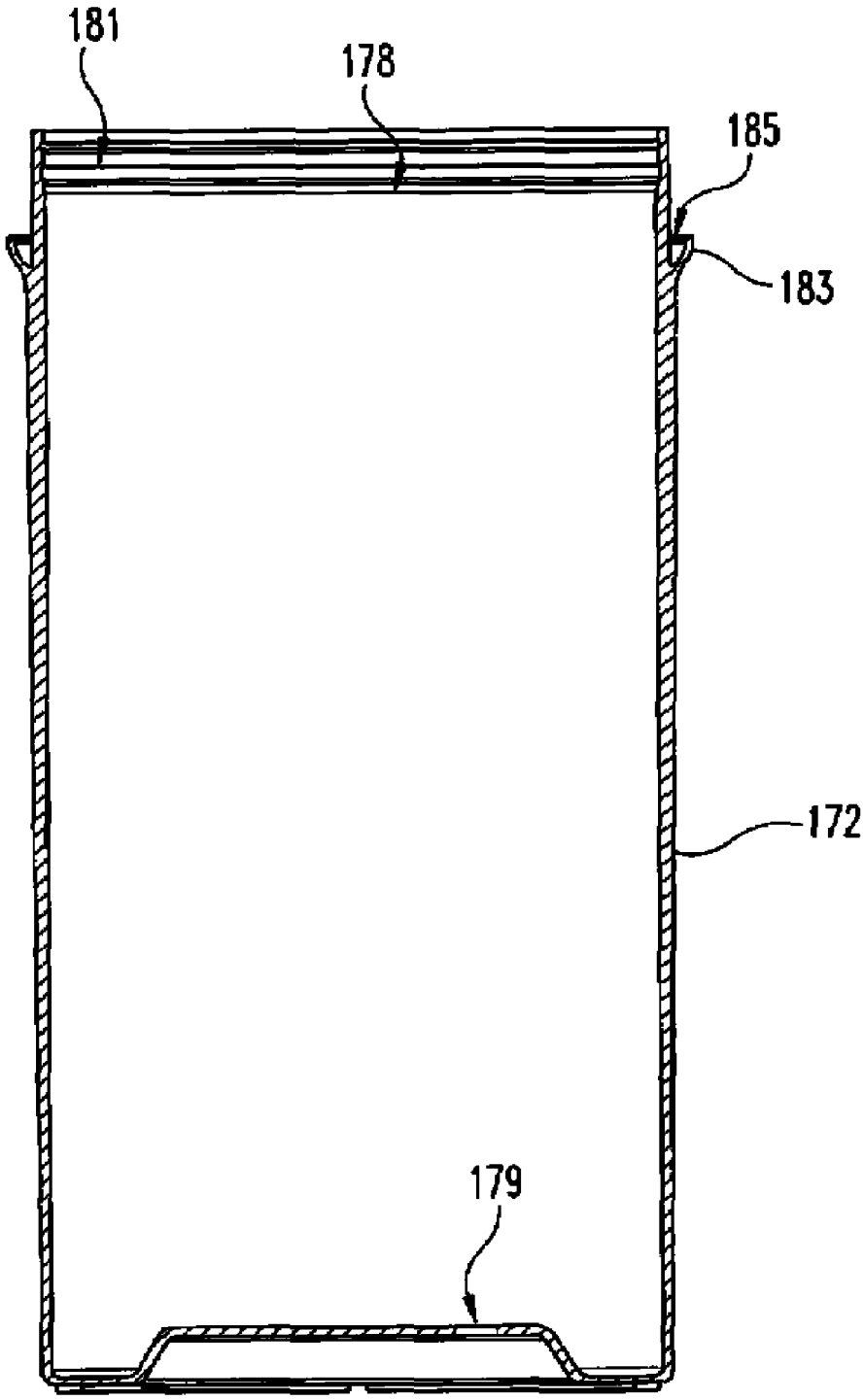
FIG. 14 is a side, cross-sectional view of a container for the FIG. 12 pump assembly.

A pump assembly 170 according to another embodiment of the present invention is illustrated in FIGS. 12 and 13. As should be recognized, the FIG. 12 pump assembly 170 shares a number of features in common with the pump assembly 30 in FIG. 1. For the sake of clarity as well as brevity, these common features will not be discussed again in great detail below, but reference is made to the previous discussion of these common features. Like before, the pump assembly 170 includes a container 172, a follower piston 175 slidably disposed in the container 172, and a pump 177 enclosing a container opening 178 of the container 172, as is depicted in FIG. 13. Opposite the container opening 178, the container 172 has a vent opening 179 (FIG. 14) that vents air into (or out of) the container 172 as the piston 175 slides within the container 172. Around the container opening 178, the container 172 has one or more pump engagement grooves 181 to which the pump 177 is secured in a snap fit manner. It should be appreciated that the pump 177 as well as other components of the pump assembly 170 can be secured in other manners, besides through a snap fit connection.

Figure 15:
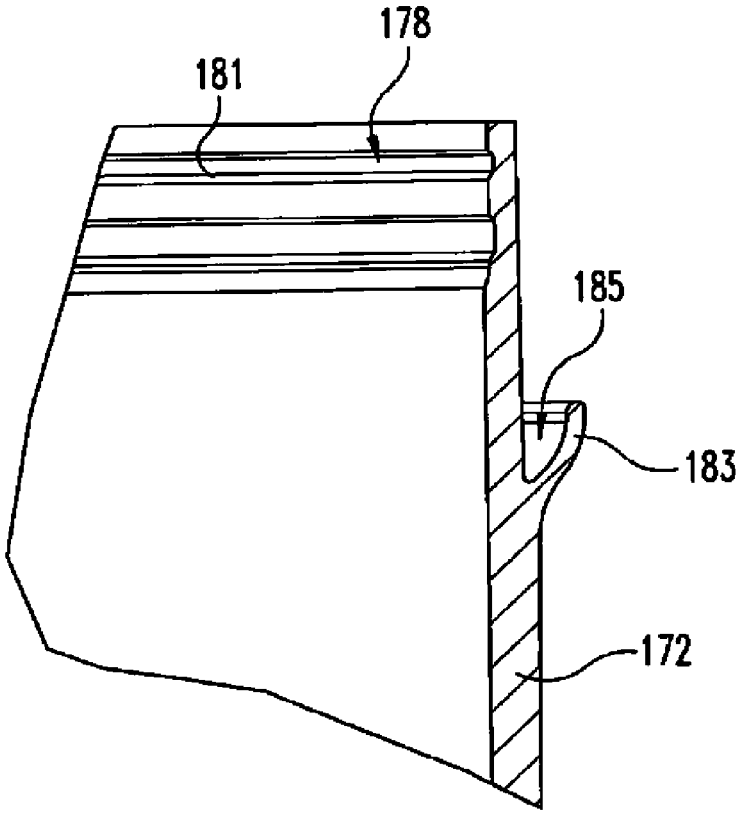
FIG. 15 is an enlarged cross-sectional view of the FIG. 14 container.

On the outside of the container 172, near the container opening 178, the container 172 in FIG. 15 has a skirt engagement flange 183 that defines a skirt groove 185 in which a skirt 188 (FIG. 13) of the pump 177 is received. Referring again to FIGS. 12 and 13, with the skirt 188 of the pump 177 tucked inside the skirt groove 185 in the container 172, it is difficult for someone to gain access to the contents of the container 172 without noticeably damaging the pump assembly 170. The pump assembly 170 does employ a tamper evidence device 190 that allows a person to open the container 172 so as to refill the container 172, for example, but at the same time, alerts the user when the container 172 has been opened for the first time. As shown, the tamper evidence device 190 includes a tamper evidence or break tab 192 with one or more frangible connections 194 that connect the break tab 192 to the skirt 188. The break tab 192 is able to be broken from the skirt 188 to open a grip opening 197 that allows the user to grip the skirt 188 and pry the skirt 188 from the skirt groove 185 in the container 172. After prying the skirt 188 from the skirt groove 185, the user is then able pull the pump 177 from the container so that the user can replenish the contents of the container 172, if so desired. Subsequently, the user can reattach the pump 177 to the container 172 so that the pump assembly 170 can be used again. With the break tab 192 removed, other users are informed that the pump assembly 170 was previously opened. In the illustrated embodiment, the grip opening 197 has a semicircular shape so that a finger, thumb or some other body part can be used to pry the skirt 188 from the container 172. As should be appreciated, the grip opening 197 can be shaped differently in other embodiments so that the skirt 188 can be gripped via a tool, such as a screw driver, or other object.

Figure 16:
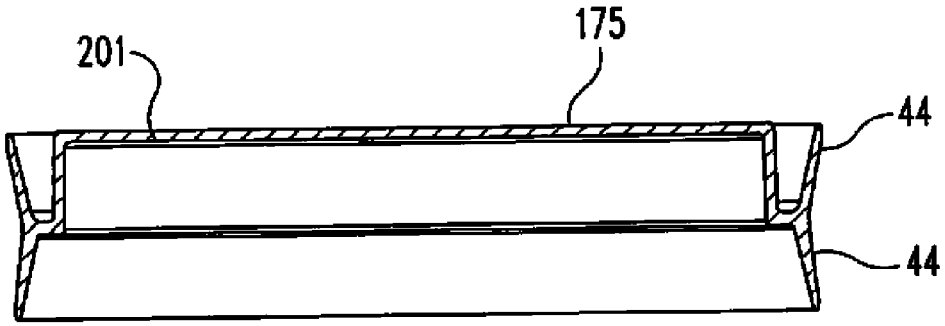
FIG. 16 is a side, cross-sectional view of a follower piston for the FIG. 12 pump assembly.

As mentioned before, the follower piston 175 is slidably disposed in the container 172 in order to generally equalize pressure when the pump 177 pumps the contents from the container 172. As can be seen in FIG. 16, the follower piston 175 shares a number of features in common with the follower piston 32 illustrated in FIG. 1, such as the upper and lower seal members 44. However, the FIG. 16 follower piston 175 has a pump contacting surface 201 that is raised so as to be generally flush with the seal member 44 that is located closets to the pump 177, as is depicted in FIG. 13. With both the bottom of the pump 177 and the pump contacting surface 201 of the follower piston 175 being flat, pump 177 and the follower piston 175 can contact one another in a flush manner such that almost all of the contents of the container can be dispensed.

With continued reference to FIG. 13, the pump 177 includes a pump shroud 203 that is coupled to a pump body or lid 205 and a pump head 208 that is able to move in a telescoping fashion relative to the shroud 203. Inside, the pump 177 further includes the inlet valve member 57 of FIG. 5, which is sandwiched between the pump body 205 and a pump cylinder 211 in a manner similar to the one illustrated in the FIG. 1 embodiment. A pump piston 214 with the outlet valve member 64 is slidably disposed in the pump cylinder 211. As illustrated in FIG. 13, the spring 67 for biasing the pump head 208 in an extended position is disposed between the pump cylinder 211 and a spring cover 216 that is coupled to the pump head 208. A nozzle plug 221 is coupled to the pump head 208 in order to minimize fluid leakage during shipping.

Figure 17:
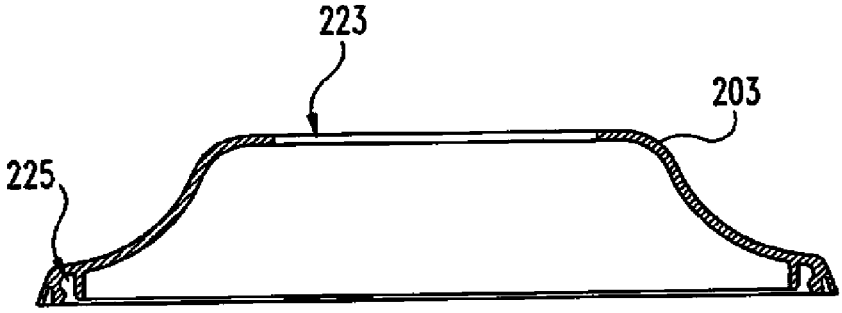
FIG. 17 is a side, cross-sectional view of a pump shroud for the FIG. 12 pump assembly.
Figure 18:
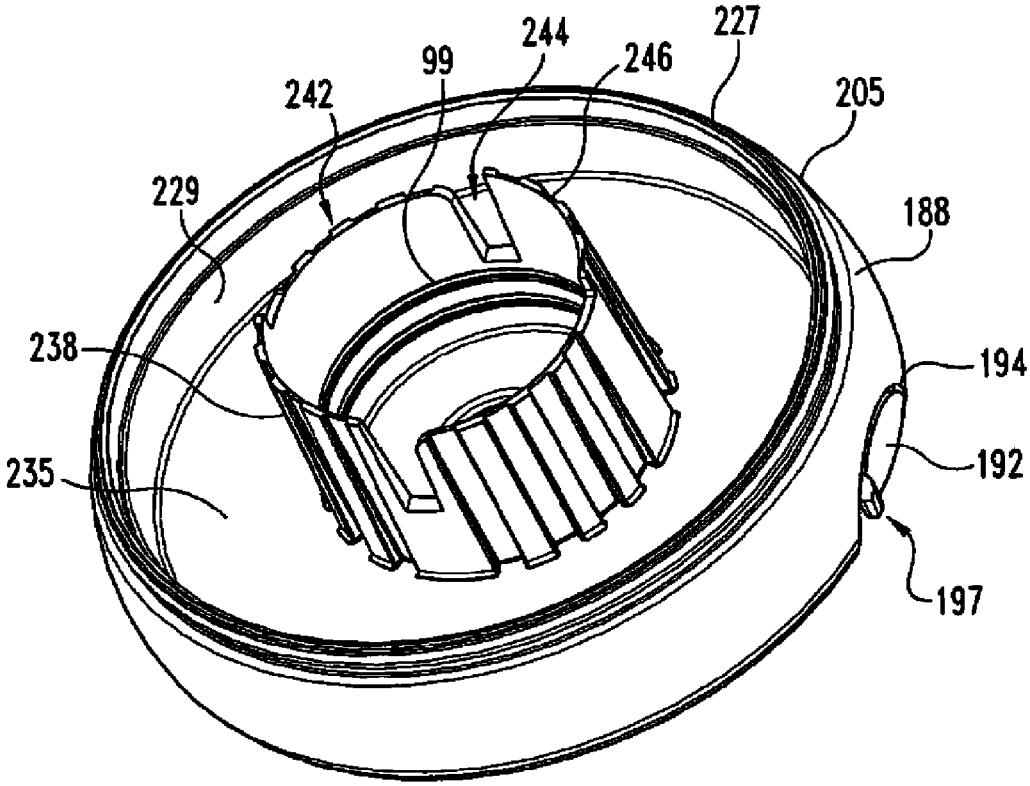
FIG. 18 is a perspective view of a pump body for the FIG. 12 pump assembly.
Figure 19:
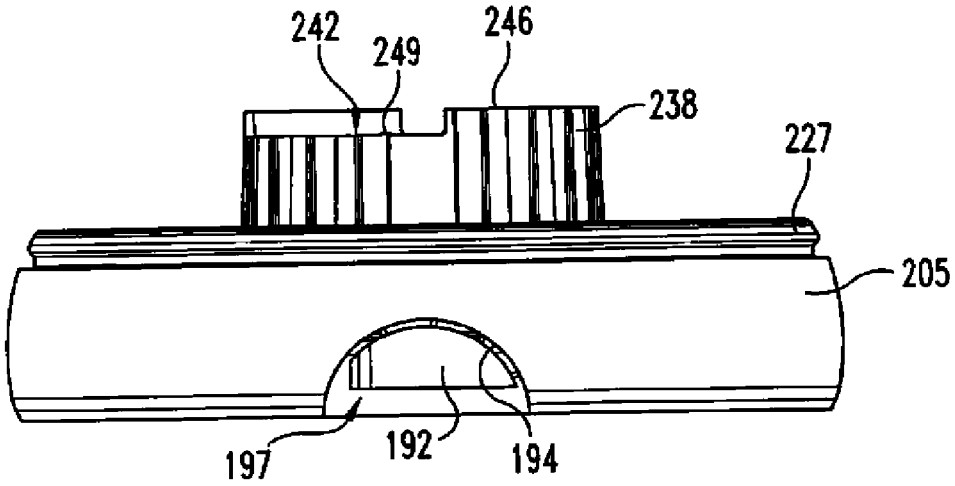
FIG. 19 is a side view of the FIG. 18 pump body.
Figure 20:
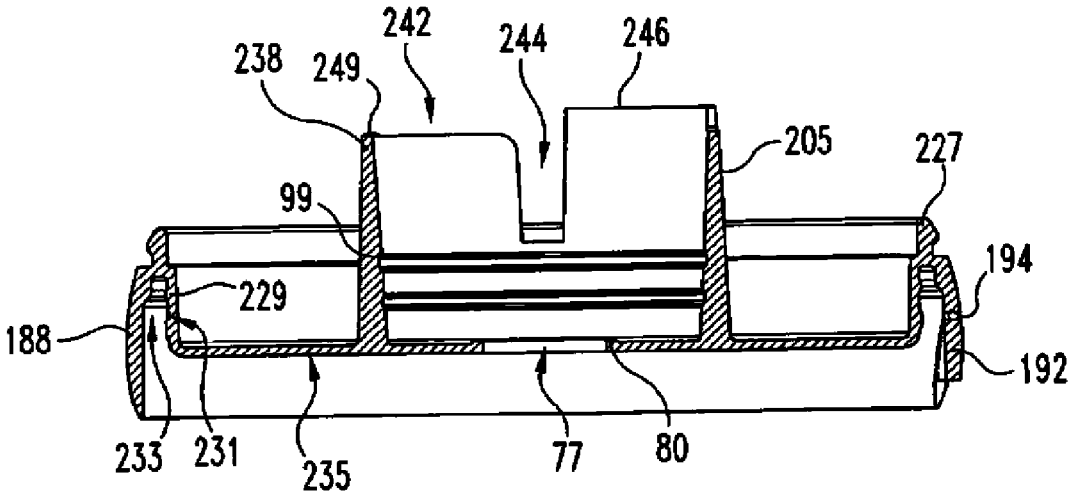
FIG. 20 is a side, cross-sectional view of the FIG. 18 pump body.
Figure 21:
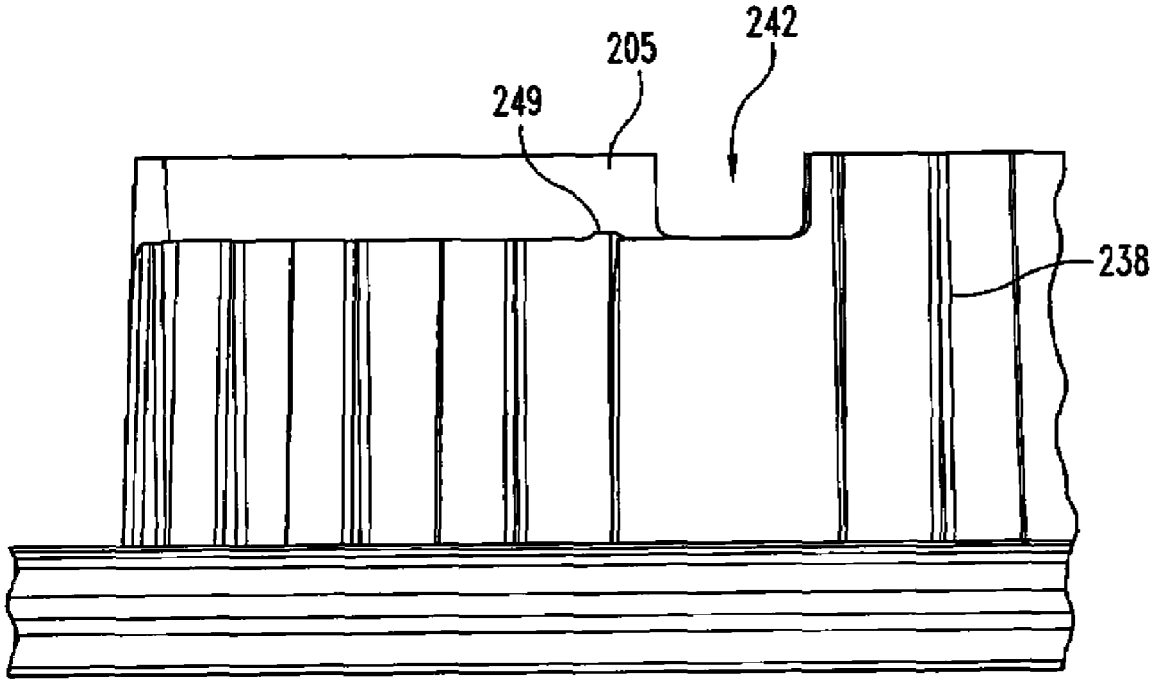
FIG. 21 is an enlarged view of the FIG. 18 pump body.
Figure 22:
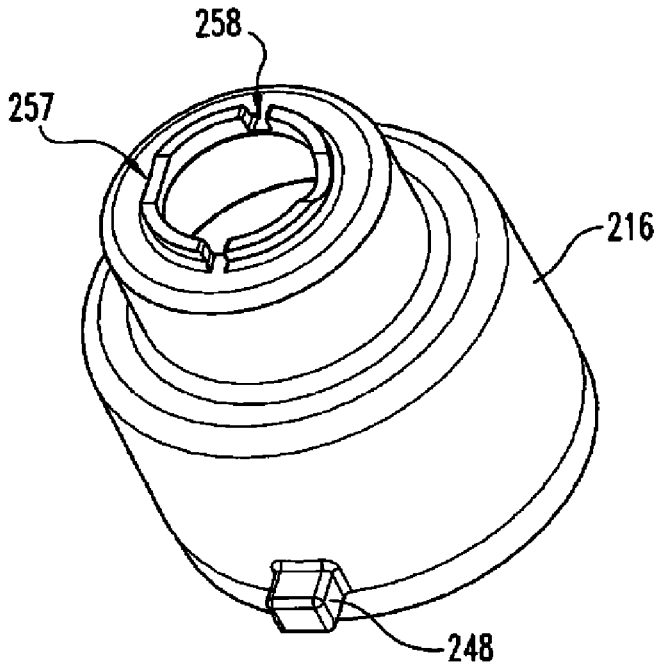
FIG. 22 is a perspective view of a spring cover for the FIG. 12 pump assembly.
Figure 23:
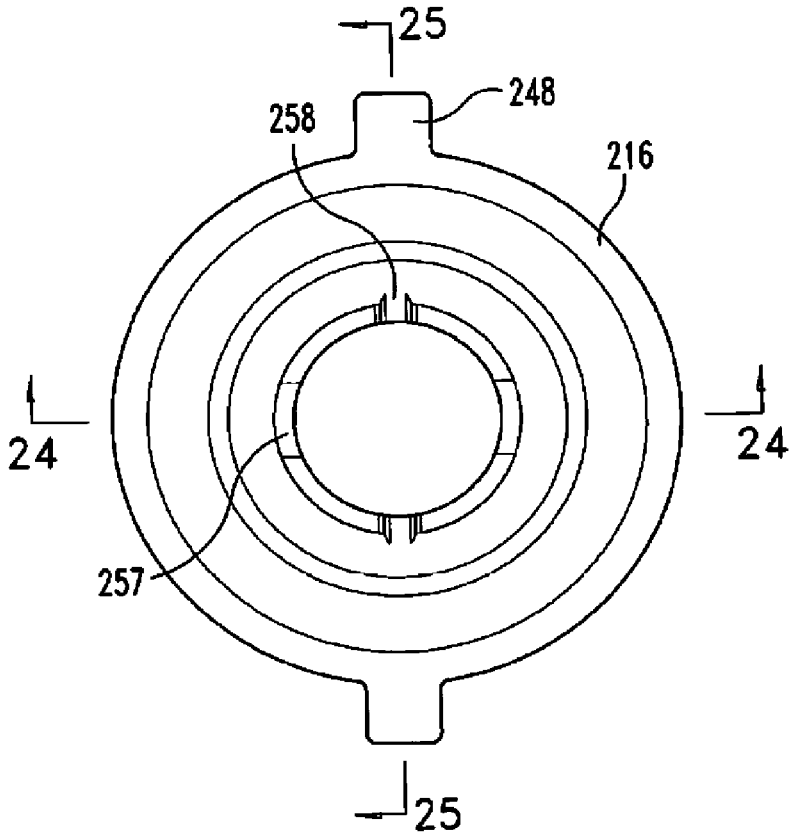
FIG. 23 is a top view of the FIG. 22 spring cover.

In the pump 177, the shroud 203 protects the components of the pump 177 from unwanted tampering. Turning to FIG. 17, the shroud 203 defines a pump head opening 223 through which the pump head 208 extends and retracts during pumping. The shroud 203 includes a female clip groove 225 that secures the shroud 203 to a male clip flange 227 on the pump body 205 (FIGS. 18 and 20). Again, it should be appreciated that the shroud 203 and the pump body 205 can be coupled together in other manners. For example, around the pump head opening 223 in one embodiment, the shroud 203 can include a pump body engagement flange that rests against the pump body 205.

Looking at FIGS. 18, 19, 20, and 21, the pump body 205 includes the skirt 188 with the break tab 192 that provides a tamper evidence feature. As can be seen in FIG. 20, the pump body 205 includes a container engagement wall 229 with one or more container engagement ridges 231 that secure the pump body 205 with the grooves 181 in the container 172 (FIG. 15). Together, the skirt 188 and the wall 229 form a container groove 233 in which the lip of the container 172 is received. A follower piston facing wall 235 extends radially inwards from the container engagement wall 229. In the illustrated embodiment, the follower piston facing wall 235 is generally flat such that the pump contacting surface 201 of the follower piston 175 is able to rest flush against the pump body 205, thereby allowing almost complete evacuation of the contents of the container 172. Like the previous embodiments, the pump body 205 defines inlet port 77 through which the contents of the container 172 is supplied. Seal ridge or seat 80, which biases against and seals with the inlet valve member 57, surrounds the inlet opening 77. The pump body 205 further has a connector 238 that extends around the inlet port 77, and the connector 238 has one or more snap grooves 99 for securing the pump cylinder 211 to the pump body 205.

To minimize leakage during shipping or in other situations, the pump 177 incorporates an up-locking feature in which the pump 177 is able to lock or hold the pump head 208 at the top of its stroke, that is, in an up or extended position. At the end of the connector 238, the pump body 205 has one or more lock notches 242, one or more corresponding guide slots 244, and one or more stop portions 246. In the illustrated embodiment, the connector 238 has two guide slots 244 that are oriented one-hundred and eighty degrees (180°) apart, but it should be recognized that the slots 244 can be oriented in other manners. As can be seen in FIGS. 22, 23, 24 and 25, the spring cover 216 includes one or more guide tabs 248 that are configured to extend through and move within the lock notches 242 and guide slots 244 of the pump body 205. In the illustrated embodiment, the guide tabs 248 extend outwardly from the spring cover 216, but in other embodiments, the guide tabs 248 can extend in other directions, such as in an inward direction.

Referring again to FIGS. 19 and 21, the pump body 205 in the lock notches 242 has one or more lock dimples or detents 249 that hold the guide tabs 248 of the spring cover 216 against the stops 246 during shipping. As should be appreciated, the guide tabs 248 can be held in place in other manners. When in the lock notches 242, the guide tabs 248 on the cover 216 are prevented from moving in a dispensing stroke direction, in other words, the down stroke direction. After shipping, the user can rotate the pump head 208 by sufficient force to disengage the guide tabs 248 from the lock detents 249. Once the guide tabs 248 of the cover 216 are positioned over the guide slots 244 in the pump body 205, the pump 177 can operate in a normal fashion and allow fluid to be dispensed by depressing the pump head 208. If so desired, the pump 177 can be relocked by rotating the pump head 208 so that the guide tabs 248 on the cover 216 disengage from the guide slots 244.

Figure 24:
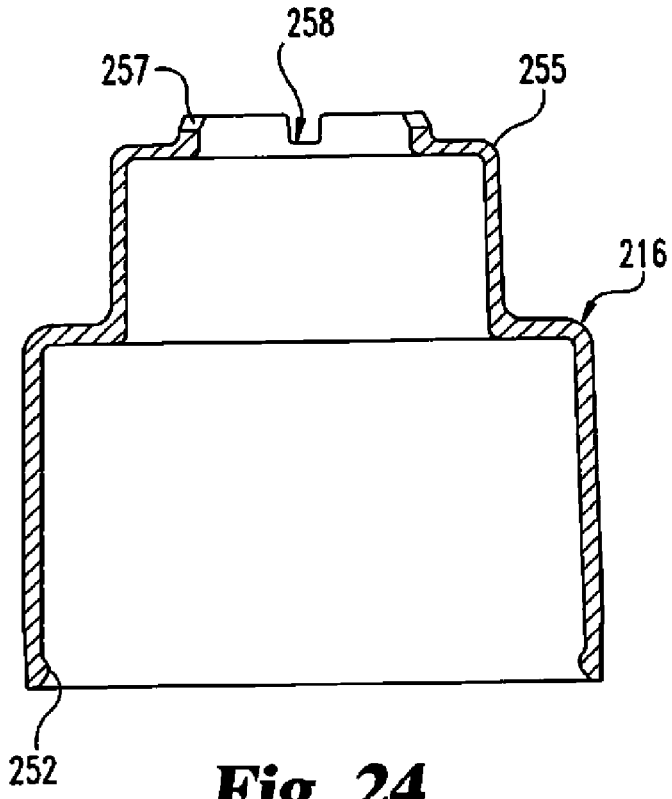
FIG. 24 is a cross-sectional view of the FIG. 22 spring cover as taken along line 24-24 in FIG. 23.
Figure 25:
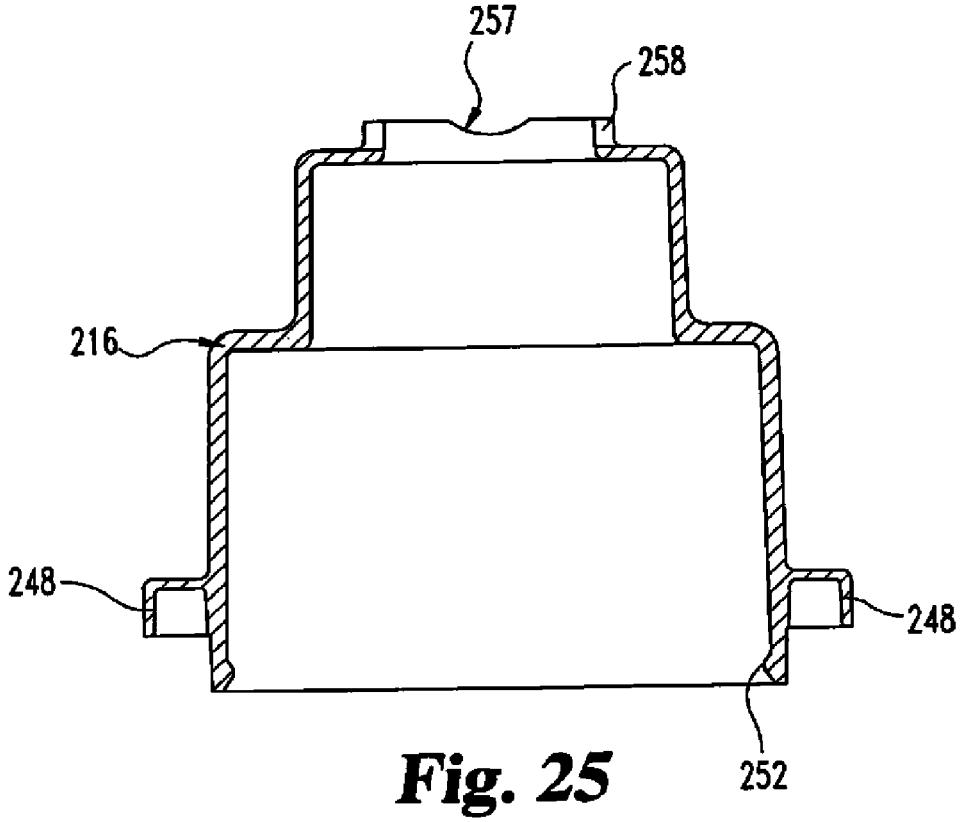
FIG. 25 is a cross-sectional view of the FIG. 22 spring cover as taken along line 25-25 in FIG. 23.

In the embodiment depicted in FIGS. 24 and 25, the spring cover 216 is hollow, and at one end, the spring cover 216 has one or more limit tabs 252 that extend radially inwards to engage the pump cylinder 211 so as to limit the travel of the pump head 208. Opposite the end with the limit tabs 252, the cover 216 has a pump head engagement portion 255 that is configured to engage the pump head 208. In the illustrated embodiment, the head engagement portion 255 has one or more nozzle relief notches 257 and one or more support relief notches 258 that respectively receive one or more curved spout portions 260 and one or more supports 261 on the pump head 208 (FIG. 26).

Figure 26:
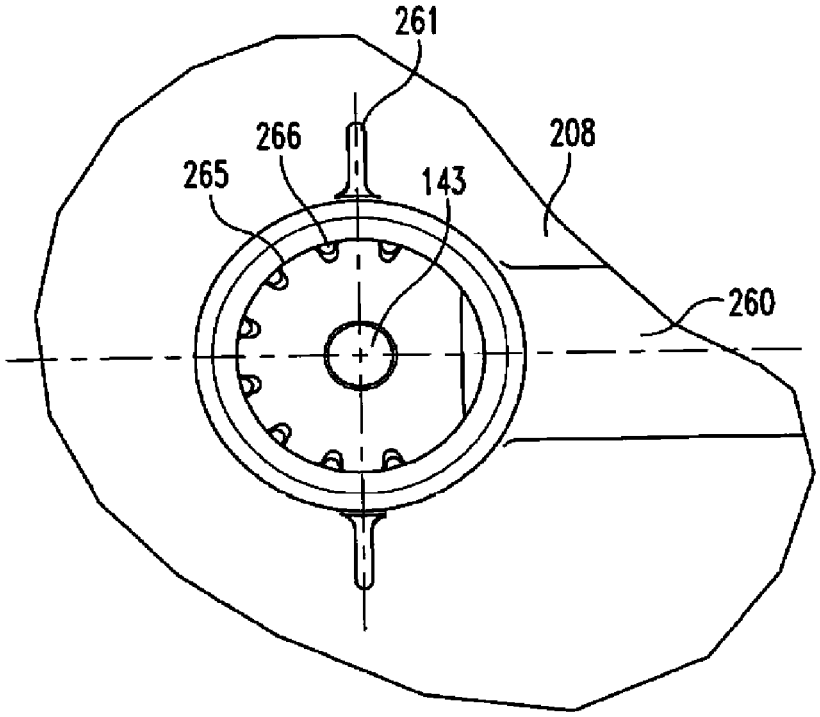
FIG. 26 is an enlarged bottom view of a pump head for the FIG. 12 pump assembly.
Figure 27:
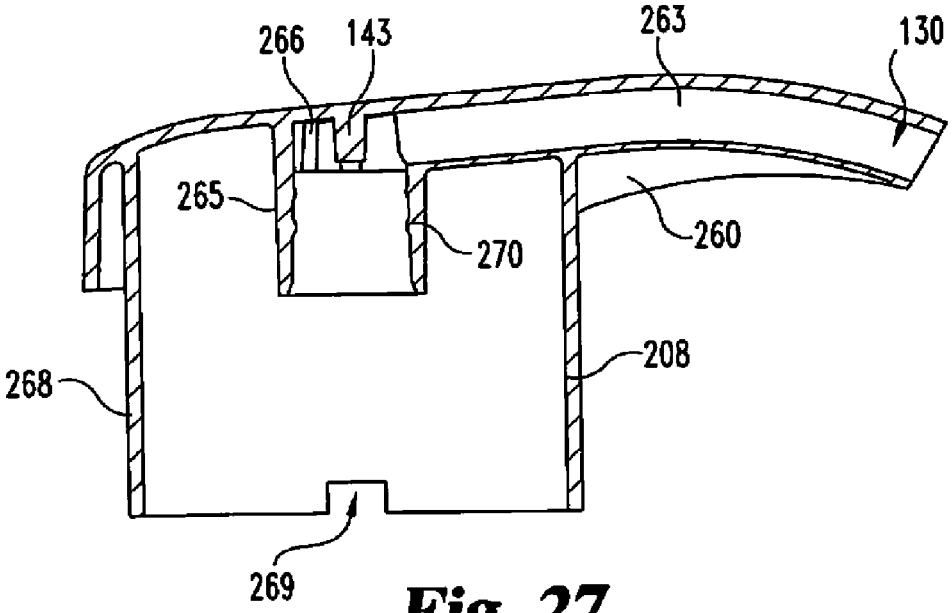
FIG. 27 is a side, cross-sectional view of the FIG. 26 pump head.

As can be seen in FIGS. 26 and 27, the pump head 208 includes an outlet nozzle 263 with outlet opening 130 that fluidly communicates with a piston connector 265. The piston connector 265 is configured to attach to the pump piston 214. Inside, the piston connector 265 has stop member 143, which limits the travel of the outlet valve member 64, and centering ribs 266 around the stop member 143 for centering the valve member 64. An outer sleeve 268 surrounds the piston connector 265, and at one end, the outer sleeve 268 has one or more guide tab notches 269 that receive the guide tabs 248 on the spring cover 216 such that the pump head 208 and the spring cover 216 rotate in unison. The piston connector 265 in FIG. 27 has one or more piston engagement ribs 270 that engage one or more grooves 271 on the pump piston 214 in a snap fit manner, as is illustrated in FIG. 28.

Figure 28:
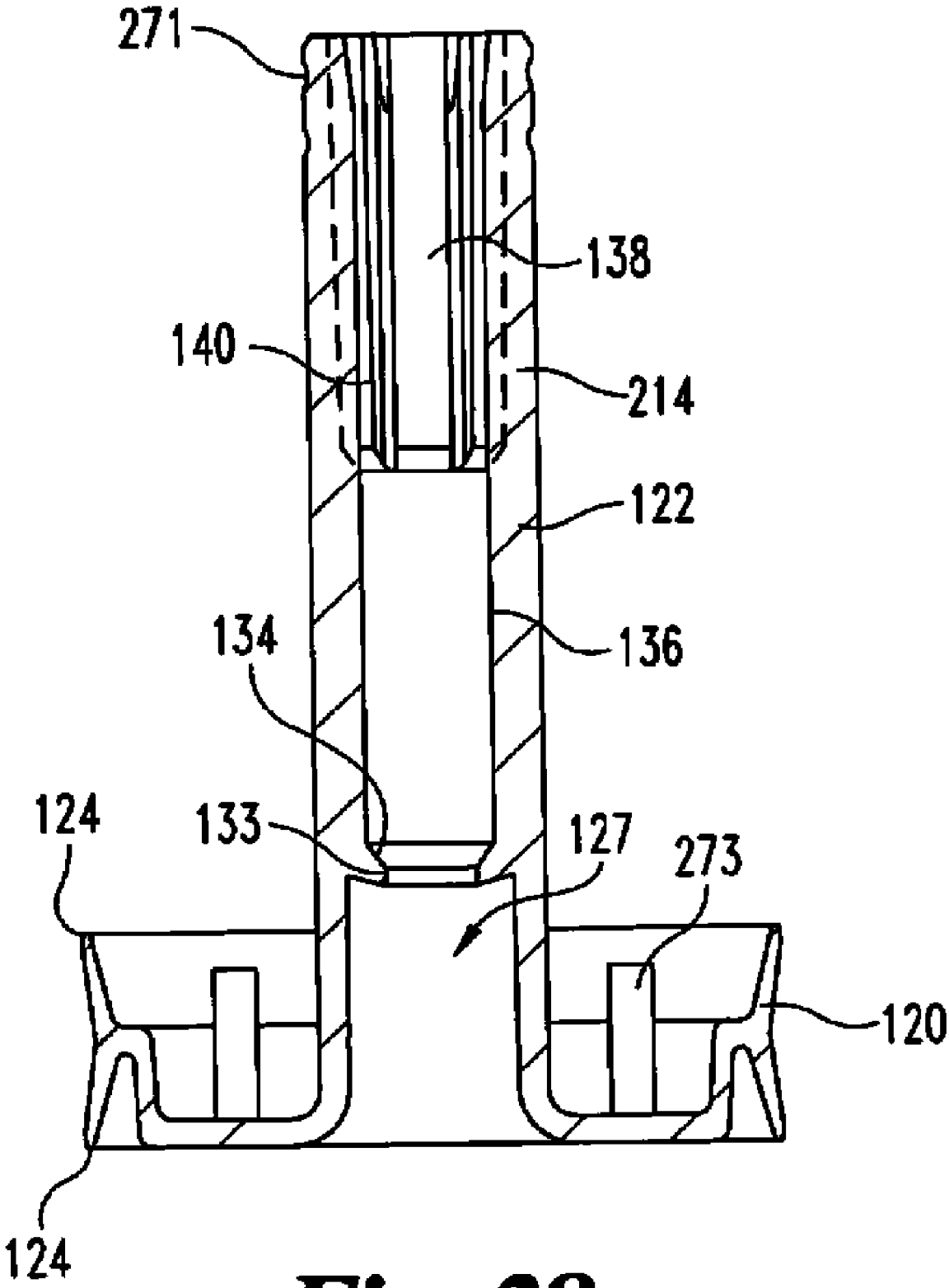
FIG. 28 is a side, cross-sectional view of a piston for the FIG. 12 pump assembly.

As should be recognized, the pump piston 214 in FIG. 28 shares a number of features in common with the piston 61 that is illustrated in FIG. 9. For example, the pump piston 214 in FIG. 28 includes the piston head 120, the shaft 122, the seal members 124, the flow passage 127 and the valve seat 133 with the conical surface 134 of the types described above with reference to FIG. 9. The spring 67 is mounted on the outside of the shaft 122, and as a consequence, the spring 67 does not come into contact with the product being dispensed. Like before, the outlet valve member 64 acts like a check valve to permit flow of the fluid in only one direction by sealing against the valve seat 133. The pump piston 214 further incorporates the suck back feature from the FIG. 9 embodiment. The flow passage 127 has a first portion 136 that is just slightly larger than the diameter (size) of the outlet valve member 64 so as to allow movement of the outlet valve member 64, while still preventing the passage of fluid around the outlet valve member 64. This tight fit between the outlet valve member 64 and the first portion 136 of the flow passage 127 creates a piston like fit that is used to draw fluid back during the upstroke of the piston 214. The flow passage 127 further has a second portion 138 that is larger than the first portion 136 such that the second portion 138 is sized large enough to permit fluid to flow around the outlet valve member 64 during the down stroke of the piston 61. In the second portion 138, the piston 61 has ribs 140 that center the outlet valve member 64 over the first portion 136. In one form, the piston head 120 for the pump piston 214 in FIG. 28 has one or more stop members 273 that limit the travel of the piston 214.

Figure 29:
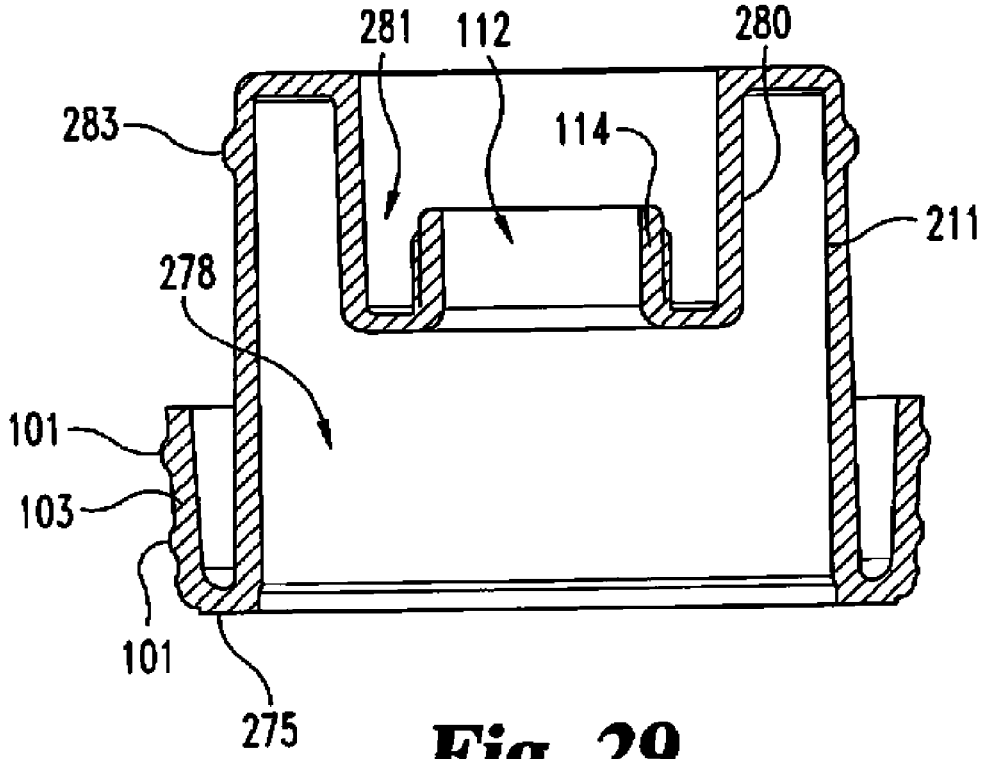
FIG. 29 is a side, cross-sectional view of a pump cylinder for the FIG. 12 pump assembly.

Referring again to FIG. 13, the pump piston 214 is slidably disposed in the pump cylinder 211. Looking at FIG. 29, the pump cylinder 211 has one or more snap ridges 101 on a body engagement flange 103 that extend from the pump cylinder 211 to engage the snap grooves 99 in the connector 238 of the pump body 205 (FIG. 20). At the end facing the inlet valve member 57, the pump cylinder 211 has a retention ridge 275 that clamps against the support member 85 on the inlet valve member 57 to hold the inlet valve member 52 over the inlet port 77 in the pump body 205. The pump cylinder 211 defines a pump cavity or chamber 278 in which the piston 214 is slidably received. Piston guide 280 with guide opening 112 extends within the pump cavity 108 of the pump cylinder 211, and guide flange 114 extends around the guide opening 112. Together, the piston guide 280 and the guide flange 114 define a spring retention groove 281 in which the spring 67 is received (FIG. 13). Unlike the FIG. 7 embodiment, the retention flange 280 in the FIG. 29 pump cylinder 211 does not jut out from the pump cylinder 211 in order to minimize the profile of the pump cylinder 211. As illustrated, the pump cylinder 211 further includes a cover retention flange 283 that is configured to engage the limit tabs 252 on the spring cover 216 (FIG. 24) during the upstroke so as to retain the cover 216.

Figure 30:
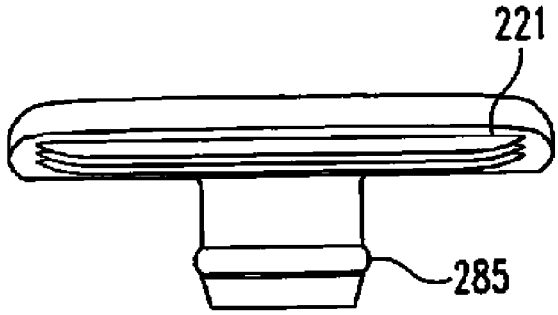
FIG. 30 is a bottom view of a nozzle plug for the FIG. 12 pump assembly.

Unlike the FIG. 1 embodiment, the nozzle plug 221 for the FIG. 13 embodiment does not incorporate the vent slot channel 150. Rather, as shown in FIG. 30, the nozzle plug 221 has a seal member 285 that completely seals the outlet opening 130 of the pump head 208 to minimize leakage. Before dispensing the contents of the container 172, the nozzle plug 221 is removed, and if so desired, the nozzle plug 221 can be re-inserted into the pump 208 after use.

As mentioned previously, during shipping and/or before use, the pump head 208 is oriented in a locked position where the pump head 208 is unable to be pressed downwards to dispense the product. Locking the pump 208 reduces the chance of fluid leakage during shipping as well as in other situations. When the pump head 208 is in the locked position, the guide tabs 248 are disengaged from the guide slots 244 in the pump body 205, and the detents 249 on the pump body 205 retain the guide tabs 248 in the lock notches 242 and against the stops 246 (FIG. 20). As noted above, the guide tab notches 269 on the pump head 208 (FIG. 27) engage the guide tabs 248 on the spring cover 216 (FIG. 25) such that the spring cover 216 rotates when the pump head 208 is rotated. Before using the pump assembly 170, the user rotates the pump head 208 such that the guide tabs 248 disengage from the detents 249 and the guide tabs 248 are rotated over the guide slots 248, thereby unlocking the pump 177.

Once the pump head 208 is rotated to an unlocked position, the pump 177 in FIG. 13 operates in generally the same fashion as the one described with reference to FIG. 1. The pump 177 in the illustrated embodiment is a manually operated by pressing on the pump head 208, but it should be appreciated that the pump 177 in other embodiments can be automatically actuated. After the pump head 208 is pushed down, the spring 67 causes the piston 214 as well as the pump head 208 to return to an extended position. On this upstroke or intake stroke of the piston 214, the outlet valve member 64 travels from the second portion 138 of the flow channel 127 to the first portion 136, as is depicted in FIG. 28. Once the outlet valve member 64 reaches the first portion 136, the outlet valve member 64 tightly slides within the first portion 136 and acts like a virtual piston, which draws back the fluid from the outlet nozzle 263 well inboard to a position in the flow passage 127 above the outlet valve member 64. By drawing the fluid from the nozzle 263, the chance of fluid encrusting at the outlet opening 130 is reduced. During the upstroke, the outlet valve member 64 eventually sits in the valve seat 133 to create a vacuum in the pump cavity. The vacuum formed in the pump cavity causes the inlet valve member 57 to open, thereby providing a wide through path for the fluid from the container 32 to enter into the pump cavity. On the down or dispensing stroke of the pump 177, the inlet valve member 57 shuts to prevent the fluid in the pump cavity from being pushed back into the container 32. The outlet valve 64 lifts off the valve seat 133 to allow fluid to be dispensed via the head nozzle 263. Specifically, as the outlet valve member 64 travels in the first portion 136, the fluid is unable to pass around the outlet valve member 64, but once the outlet valve member 64 reaches the larger second portion 138 of the flow passage 127, the fluid is able to pass around the outlet valve 57 and out the nozzle 263. Additional fluid can be dispensed by repeated pressing and releasing of the pump head 208 in the manner as described above. After use, the user can rotate the pump head 208 so that the pump 177 is again locked, if so desired.

Figure 31:
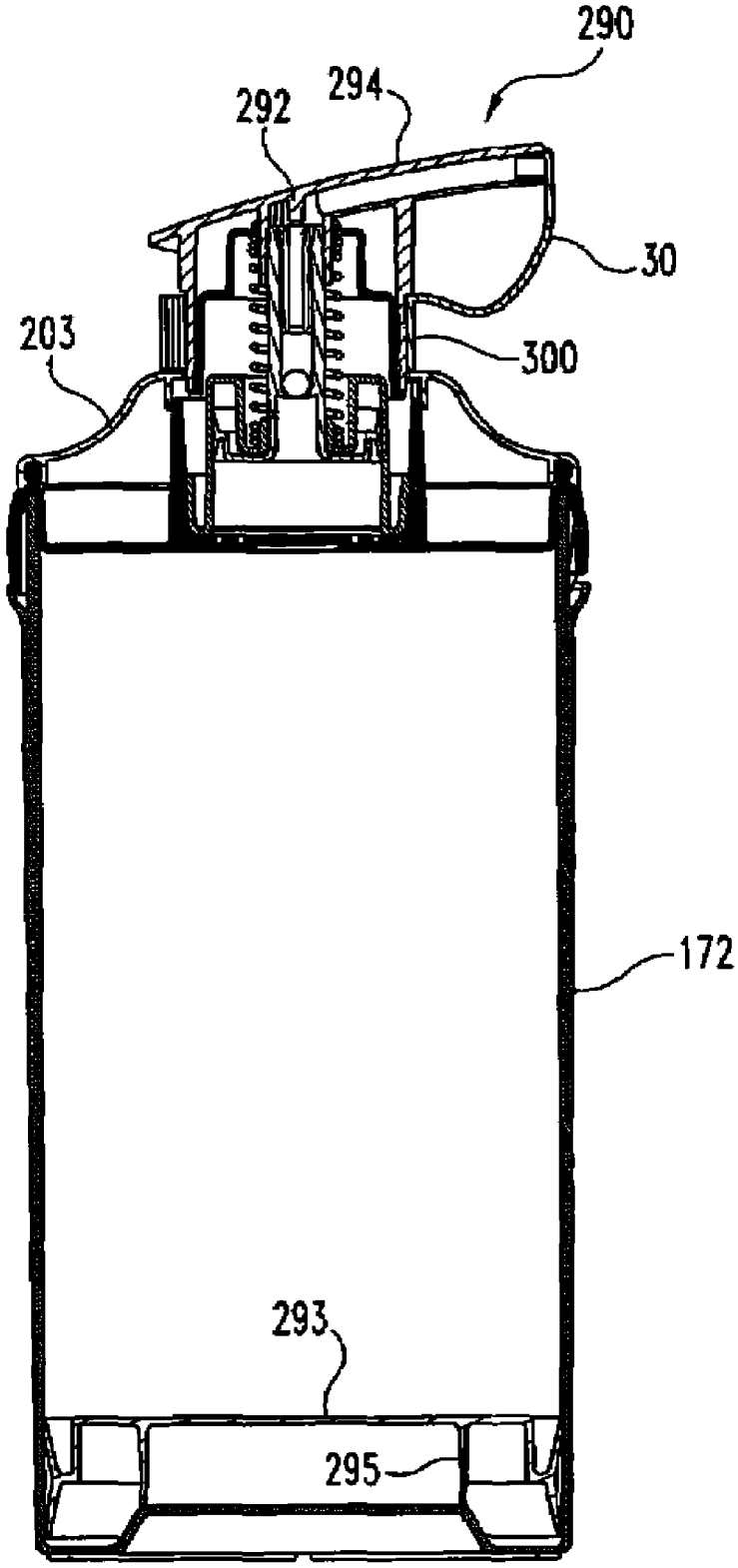
FIG. 31 is a side, cross-sectional view of a pump assembly that incorporates a tamper evidence strap according to a further embodiment.
Figure 32:
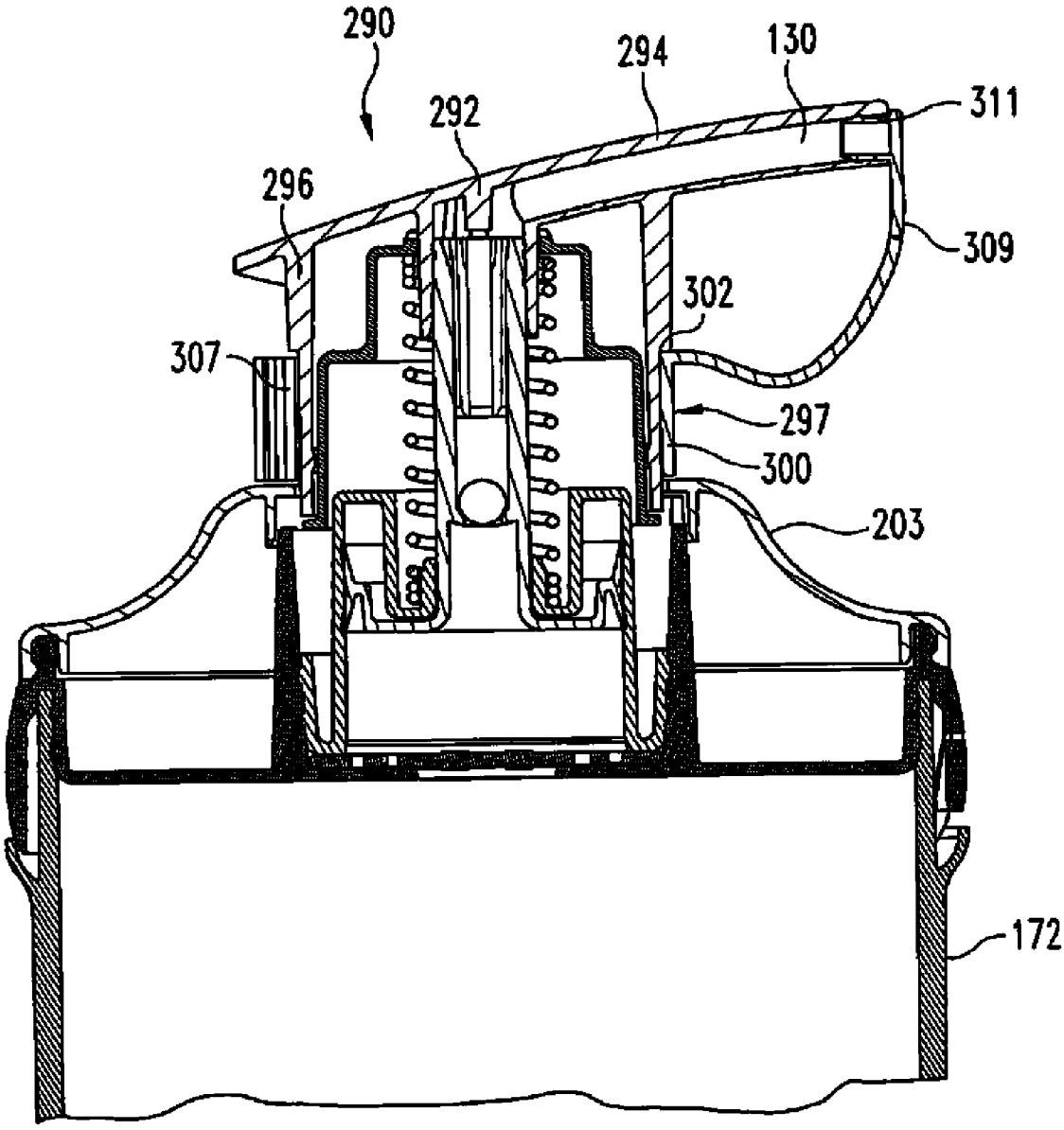
FIG. 32 is an enlarged, cross-sectional view of the FIG. 31 pump assembly.

A pump assembly 290 that includes a tamper evidence feature according to another embodiment is illustrated in FIGS. 31 and 32. The tamper evidence feature in FIG. 31 can be used as an alternative for or in addition to other types tamper evidence features. As shown, the pump assembly 290 includes an airless dispensing pump 292 with the same components as the pump assembly 170 illustrated in FIG. 13, except for a few modifications to its follower piston 293 and pump head 294. In particular, as shown in FIG. 31, the follower piston 293 includes a support flange 295 that rests against the closed end of the container 172 when the container is full. Looking at FIG. 32, the pump head 294 has an outer sleeve 296 with a relief notch 297 that receives a tamper evidence ring (TER) or strap 300. Among its many functions, the tamper evidence ring 300 locks the pump head 294 in the extended or upstroke position. As can be seen, the tamper evidence ring 300 is wrapped around the outer sleeve 296 of the pump head 294 in the relief notch 297. One side of the tamper evidence ring 300 rests against an engagement edge 302 of the notch 297. The other side of the tamper evidence ring 300 rests against the pump shroud 203. The tamper evidence ring 300 includes an attachment strap or loop 307 that is wrapped around the pump head 294 and a nozzle plug 309 that is coupled to the attachment strap 307 in a manner such that the nozzle plug 309 is able to be torn from the attachment strap 309. The nozzle plug 309 includes a seal portion 311 that is fitted into the outlet opening 130 of the pump head 294 in order to reduce leakage.

FIGS. 31 and 32 illustrate the configuration of the tamper evidence ring 300 before initial use of the pump 292, such as during shipping and initial storage. With the attachment strap 307 disposed between the engagement edge 302 of the pump head 294 and the pump shroud 203, the pump 292 is prevented from being actuated. Before the pump 292 is used, the nozzle plug 309 is torn from the attachment strap 307, which in turn breaks the strap 307, thereby permitting actuation of the pump 292. With the nozzle plug 309 torn off the strap, the nozzle plug 309 can then be used to re-plug the outlet opening 130.

Figure 33:
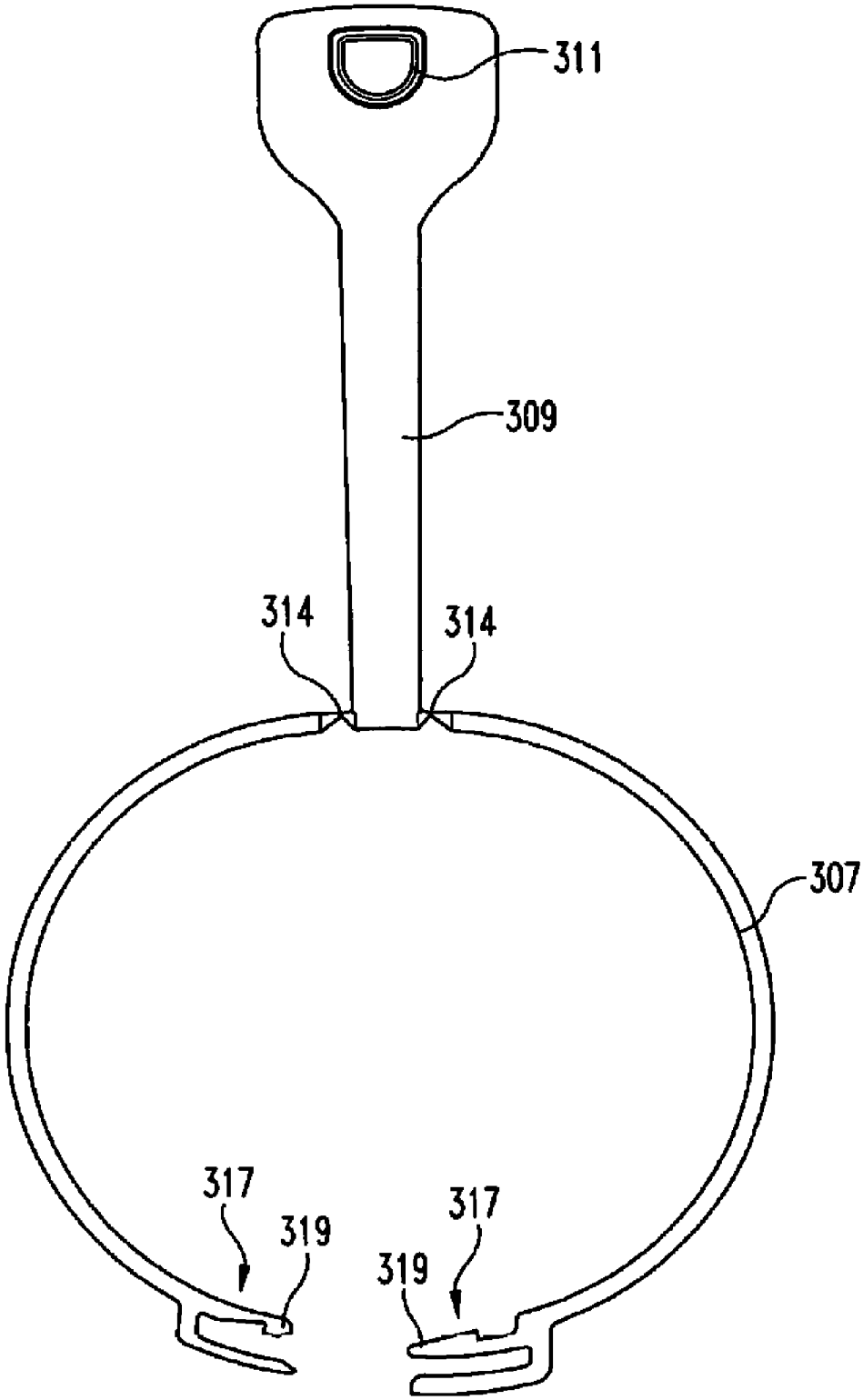
FIG. 33 is a bottom view of the FIG. 31 tamper evidence strap.

Referring to FIG. 33, the attachment strap 307 has one or more breakable portions 314 near the nozzle plug 309 that are narrower than the rest of the rest of the attachment strap 307. In the embodiment shown, two breakable portions 314 are positioned on opposite sides of the nozzle plug 309 that break the strap upon removal of the plug 309. During assembly, ends 317 of the attachment strap 307 are secured together. The ends 317 have fingers 319 that engage one another in an interlocking fashion. The inner radial fingers 319 use a lock tab type connection to secure the ends together. Once the ends 317 are snapped together, the ends 317 cannot be easily broken. It is envisioned that in other embodiments the ends 317 can be connected in other manners. In the illustrated embodiment, the attachment strap 307 has a generally circular shape, but it should be understood that the attachment strap 307 can be shaped differently depending on the shape of the pump head 294.

Figure 34:
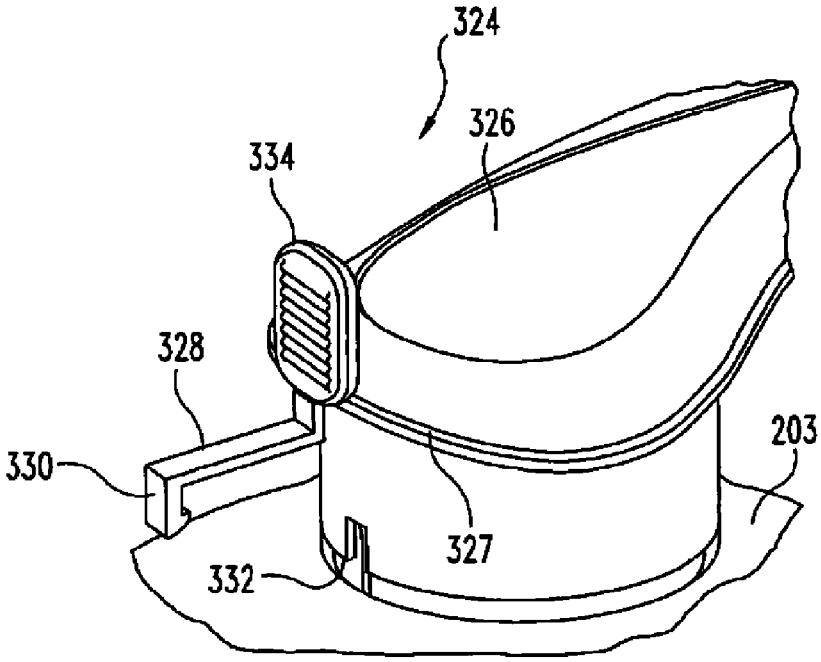
FIG. 34 is a partial, perspective view of a pump assembly according to another embodiment with a wrap under tamper evidence plug in an unlocked position.
Figure 35:
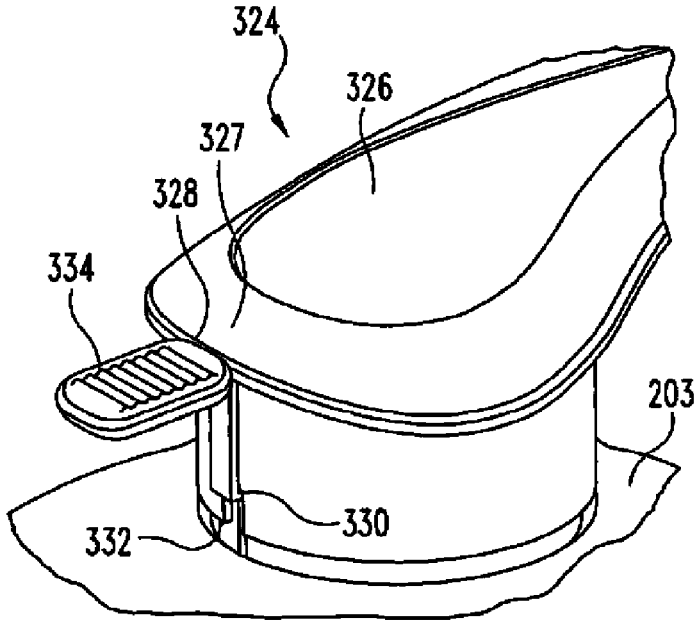
FIG. 35 is a partial, perspective view of the FIG. 34 pump assembly with the wrap under tamper evidence plug in the locked position.

FIGS. 34 and 35 illustrate a pump assembly 324 that includes a pump head 326 that has a wrap under tamper evidence plug 328 according to another embodiment. The tamper evidence plug 328 is generally Z-shaped with a barbed lock insert 330 that is inserted into a lock notch 332 in the pump head 326. In the depicted embodiment, the tamper evidence plug 328 is pivotally coupled to a rim 327 of the pump head 326 via a living hinge, but in other embodiments, the tamper evidence plug 328 can be coupled to the pump head 326 in other manners. The lock notch 332 is positioned near the pump shroud 203, and once the barbed lock insert 330 is pivoted to engage the lock notch 332, the tamper evidence plug 328 forms a brace between the rim 327 of the pump head 326 and the pump shroud 203, thereby preventing the pump head 326 from being depressed.

The tamper evidence plug 328 has a pull tab 334 that is grasped by the user in order to remove the plug 328 prior to use. To remove the tamper evidence plug 328, the user pulls on the pull tab 334 such that the living hinge between the plug 328 and the pump head 326 is broken, and the barbed lock insert 330 is pulled from the lock notch 332. Once the tamper evidence plug 328 is removed, the pump head 326 can be actuated so as to dispense the contents of the container 172.

Figure 36:
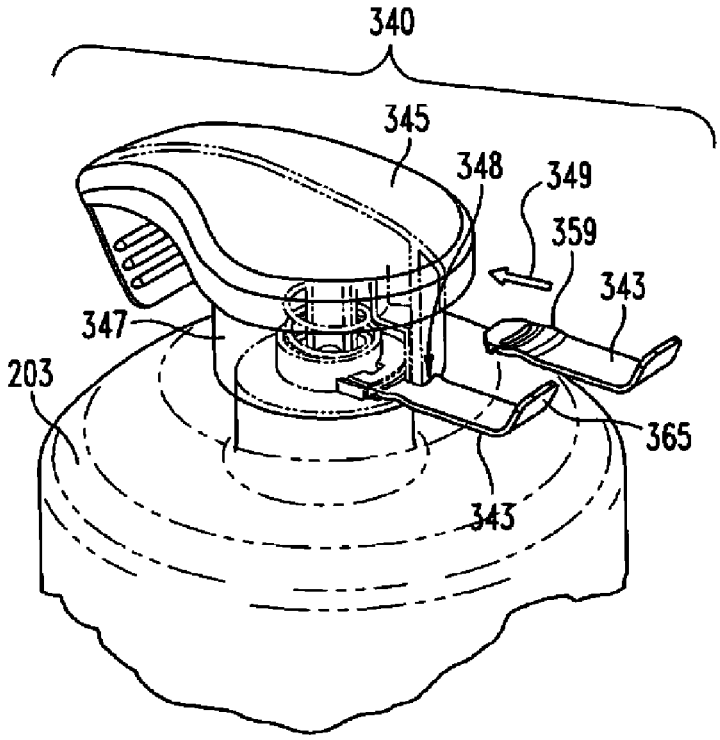
FIG. 36 is a partial perspective view of a pump assembly with an anti-rotation tab according to still yet another embodiment.
Figure 37:
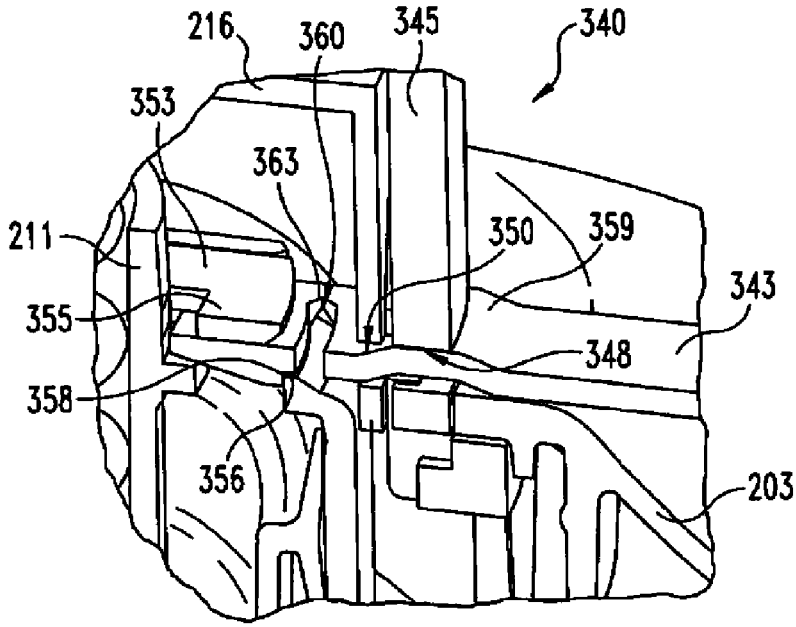
FIG. 37 is an enlarged, cross-sectional view of the FIG. 36 pump assembly.

With reference to FIGS. 36 and 37, a pump assembly 340 according to another embodiment includes a tamper evidence feature that includes an anti-rotation tab 343 that prevents rotation of the pump head 345. Pump mechanism 347 in FIG. 36 operates in a fashion similar to the one illustrated in FIG. 13, in that, to actuate the pump 347, the pump head 345 needs to be rotated to an unlocked position. During assembly, the tab 343 is inserted into an anti-rotation slot 348 in the pump head 345, in the direction as indicted by direction arrow 349 in FIG. 36. Inside the pump head 345, the spring cover 216 has a tab slot 350 that receives the anti-rotation tab 343. As can be seen in FIG. 37, the pump cylinder 211 has a connector 353 that is configured to secure the end of the anti-rotation tab 343 to the pump cylinder 211. The connector 353 includes a biasing tab 355 that is bendable and a barbed lock tab 356 that engages a barbed end 358 of the anti-rotation tab 343. During insertion, the barbed end 358 of the anti-rotation tab 343 slides along the barbed lock tab 356 in the connector 353, and the biasing tab 355 presses and holds the barbed end 358 of the anti-rotation tab 343 in engagement with the barbed lock tab 356. The anti-rotation tab 343 further has a bend portion 359 that biases the barbed end 358 into engagement with the connector 353, which in turn reduces the chance of disengagement. Near the connector 353, the anti-rotation tab 343 has a slot 360 that forms opposing break portions 363. It should be recognized that other embodiments can include more or less break portions 363 than shown and/or include other types of frangible structures. Before use, the user pulls on a bent grip portion 365 of the anti-rotation tab 343 such that break portions 363 break in order to allow for the removal of the anti-rotation tab 343. With the break portions 363 broken, the anti-rotation tab 343 cannot be reattached to the pump head 345, and consequently, provides evidence of someone tampering with the pump assembly 340. Once the anti-rotation tab 343 is removed, the pump head 345 can be rotated to the position that allows pumping.

Figure 38:
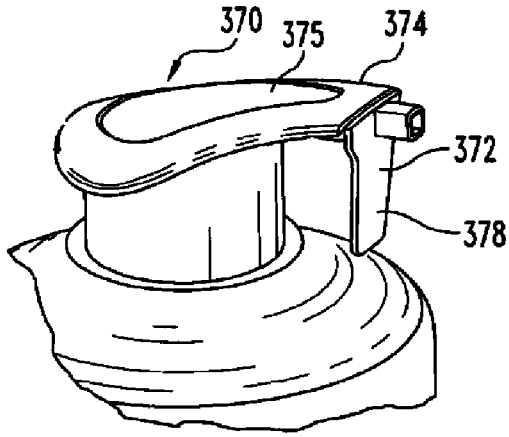
FIG. 38 is a partial perspective view of a pump assembly according another embodiment with a first plug of a dual plug nozzle cover inserted into a nozzle opening.
Figure 39:
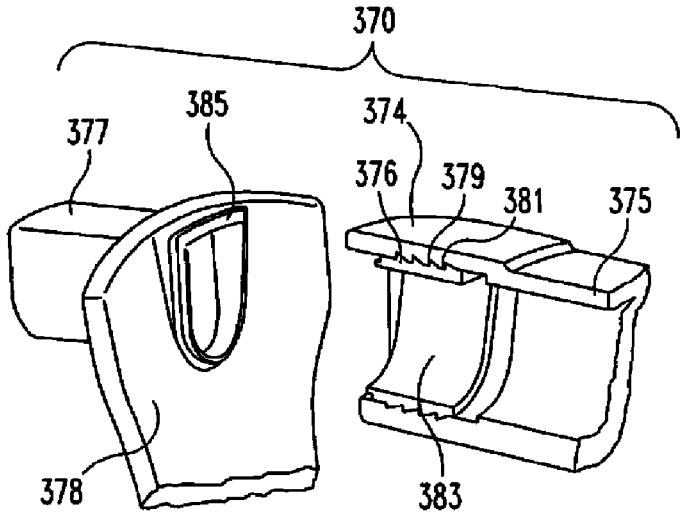
FIG. 39 is a partial perspective view of the FIG. 38 pump assembly with the first plug detached from the rest of the dual plug nozzle cover.
Figure 40:
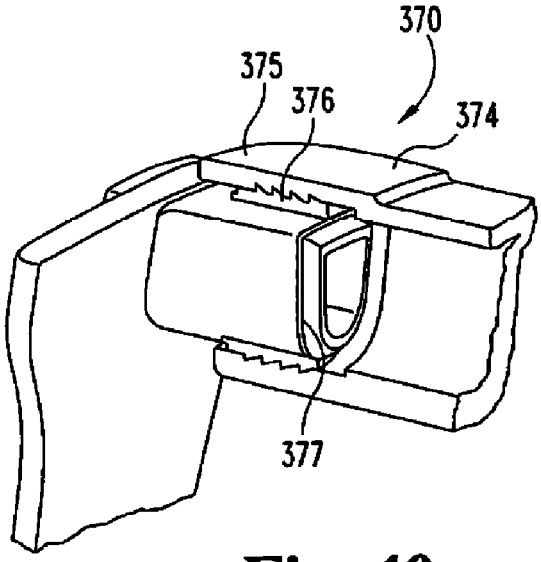
FIG. 40 is a partial perspective view of the FIG. 38 pump assembly with a second plug of the dual plug nozzle cover inserted into the nozzle opening.

A pump assembly 370 that incorporates a tamper evidence feature according to a further embodiment will now be described with reference to FIGS. 38, 39 and 40. In the illustrated embodiment, a dual plug nozzle cover 372 is inserted into a nozzle 374 of a pump head 375, after the functionality of the pump has been tested. As shown, the nozzle cover 372 includes two plugs, a first plug 376 and a second plug 377, that extend from a pull tab 378 of the cover 372 in an opposing fashion. In other embodiments, the plugs 376, 377 can other orientations. The first plug 376 has a series of serrations 379 that engage corresponding serrations 381 inside the nozzle 374. The serrations 379 on the first plug 376 are configured to retain the first plug 379 inside the nozzle 374 such that the first plug 376 cannot be easily removed without being damaged. As can be seen in FIG. 38, the first plug 376 is hollow and defines a plug cavity 383 that is sized to receive the second plug 377. Near the pull tab 378, the nozzle cover 372 has a frangible section 385 that is thinner than the rest of the first plug 376 so that the first plug 376 can be detached from the nozzle cover 372. As mentioned before, the second plug 377 is sized to fit inside the plug cavity 383 when the first plug 376 is detached from the nozzle cover 372. Before shipping, the first plug 376 is inserted into the nozzle 374 to prevent leakage during shipping as well as before initial use. Prior to use, the user pulls the nozzle cover 372 from the nozzle 374 via the pull tab 378. As the nozzle cover 372 is pulled, the frangible section 385 breaks such that the first plug 376 remains inside the nozzle 374 as evidence that the nozzle cover 372 was removed. When the pump head 375 pumps the fluid, the fluid passes through the plug cavity 383. If so desired, the user can reseal the nozzle 374 by inserting the second plug 377 into the plug cavity 383. The second plug 377 is configured to be repeatedly removed and reinserted into the nozzle 374.

Figure 41:
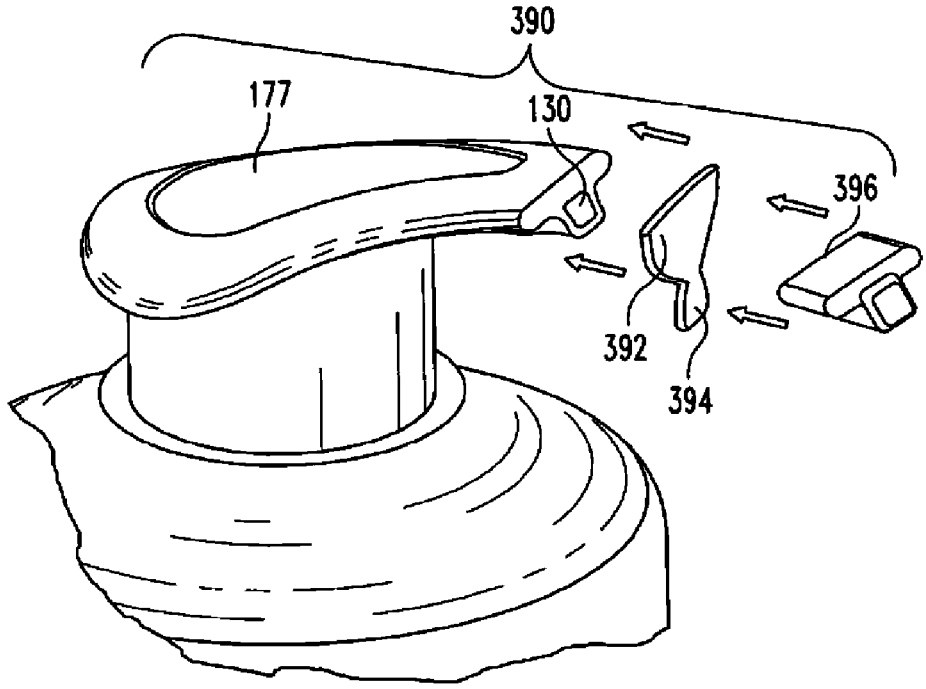
FIG. 41 is a perspective view of a pump assembly with a nozzle cover sheet according to a further embodiment.

A pump assembly 390 with a tamper evidence feature according to still yet another embodiment is depicted in FIG. 41. As shown, a nozzle cover sheet or foil 392 seals the outlet opening 130 of the pump head 177. The cover sheet 392 is sealed to the pump head 177 after the functionality of the pump is tested. In one form, the nozzle cover sheet 392 is attached to the pump head 177 via heat sealing, but it should be appreciated that the nozzle cover sheet 392 can be attached in other manners, such as through an adhesive. The nozzle cover sheet 392 has a pull tab 394 for pulling the nozzle cover sheet 392 from the pump head prior to use. The pump assembly 390 in FIG. 41 further includes a protective cap 396 that provides additional protection for the cover sheet 392. After the cover sheet 392 is removed, the user can refit the protective cap 396 over outlet opening 130 of the pump head 177 for hygienic purposes, if so desired. In one form, the protective cap 396 is made of plastic, but the protective cap 396 can be made of other materials in other embodiments.

Figure 42:
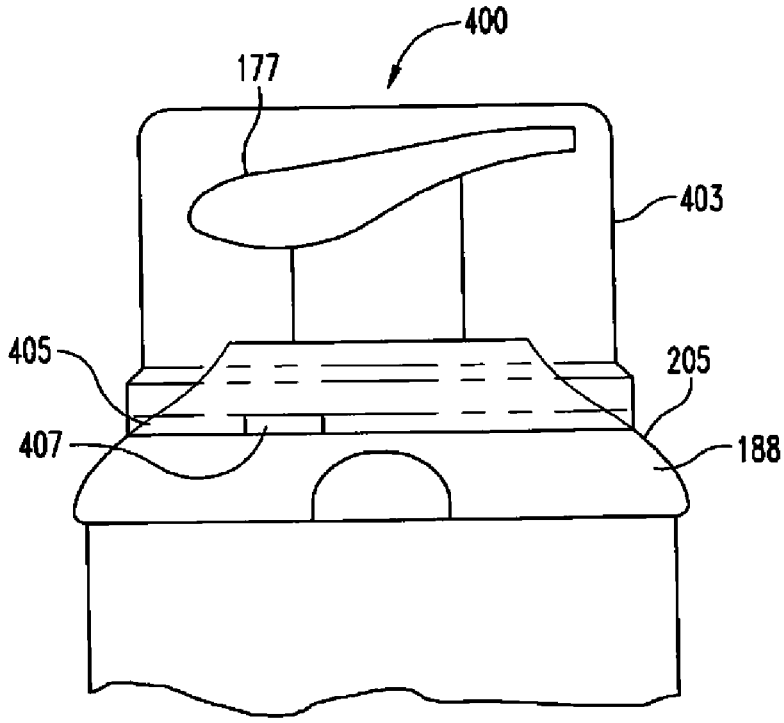
FIG. 42 is a side view of a pump assembly with a tamper evidence cap according to yet another embodiment.

FIG. 42 illustrates a further embodiment in which a pump assembly 400 includes a pump cap 403 that covers the pump head 177. After the function of the pump is tested during assembly, the cap 403 is fitted over the pump head 177 in order to prevent accidental actuation of the pump. In one form, the pump cap 403 is detachably coupled to the skirt 188 of the pump body 205 via a tear off band 405 with a pull tab 407. Before initial use, the user tears off the band 405 by pulling on the pull tab 407. After use, the user can recover the pump 177 with the cap 403, if so desired.

It should be recognized that the tamper evidence features of the above described embodiments can be used individually or together in various combinations. Further, it is envisioned that the tamper evidence features can be modified for use with other types of pumps, besides those shown in the drawings.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

What is claimed is:

1. A pump assembly, comprising:

a pump including a nozzle opening;

a nozzle cover including a pull tab, a first plug extending from the pull tab and a second plug extending from the pull tab, the first plug defining a plug cavity sized to receive the second plug, the first plug being secured in the nozzle opening and having a frangible portion for separating the first plug from the pull tab;

the first plug being configured to seal the nozzle opening by plugging the nozzle opening when the first plug is attached to the pull tab; and the second plug being configured to seal the nozzle opening by plugging the plug cavity in the first plug when the first plug is separated from the pull tab.

2. The pump assembly of claim 1, further comprising:

the first plug including serrations to retain the first plug in the nozzle opening.

3. The pump assembly of claim 2, further comprising:

the nozzle opening including serrations engaging the serrations of the first plug.

4. The pump assembly of claim 1, in which the first plug and the second plug extend in an opposing fashion.

5. The pump assembly of claim 1, in which the frangible portion is thinner than the rest of the first plug.

6. The pump assembly of claim 5, further comprising:

a container including a skirt flange with a skirt groove; and the pump including a skirt received in the skirt groove, the skirt including a break tab that is configured to form a grip opening once the break tab is removed for permitting removal of the pump from the container.

7. The pump assembly of claim 1, in which the second plug remains attached to the pull tab when the pull tab is separated from the first plug.

8. A method, comprising:

leaving an identifier at a nozzle that a nozzle cover sealing the nozzle was removed from the nozzle;

wherein the nozzle cover includes a first plug with a frangible section and a second plug;

wherein the first plug defines a plug cavity;

wherein said leaving the identifier at the nozzle includes keeping the first plug inside the nozzle by breaking the frangible section;

dispensing fluid through the plug cavity of the first plug after the frangible section is broken; and resealing the nozzle with the nozzle cover by plugging the plug cavity with the second plug.

9. The method of claim 8, in which said leaving the identifier at the nozzle includes pulling a pull tab of the nozzle cover.

10. The method of claim 9, in which the second plug remains attached to the pull tab after said pulling the pull tab.

11. The method of claim 8, further comprising:

wherein the first plug and the second plug extend in an opposing fashion.

12. A pump assembly, comprising:

a pump including a nozzle opening; and a nozzle cover including a pull tab, a first plug extending from the pull tab and a second plug extending from the pull tab, the first plug defining a plug cavity sized to receive the second plug, the first plug being secured in the nozzle opening and having a frangible portion for separating the first plug from the pull tab, in which the first plug and the second plug extend in an opposing fashion.

13. The pump assembly of claim 12, further comprising:

the first plug including serrations to retain the first plug in the nozzle opening.

14. The pump assembly of claim 13, further comprising:

the nozzle opening including serrations engaging the serrations of the first plug.

15. The pump assembly of claim 12, in which the frangible portion is thinner than the rest of the first plug.

16. The pump assembly of claim 15, further comprising:

a container including a skirt flange with a skirt groove; and the pump including a skirt received in the skirt groove, the skirt including a break tab that is configured to form a grip opening once the break tab is removed for permitting removal of the pump from the container.

17. The pump assembly of claim 12, in which the frangible portion is located inside the nozzle opening so that the first plug is located inside the nozzle opening when the first plug is separated from the pull tab.

18. The pump assembly of claim 12, further comprising:

the first plug being configured to seal the nozzle opening by plugging the nozzle opening when the first plug is attached to the pull tab; and the second plug being configured to seal the nozzle opening by plugging the plug cavity in the first plug when the first plug is separated from the pull tab.

19. The pump assembly of claim 18, in which the second plug remains attached to the pull tab when the pull tab is separated from the first plug.

* * * * *